US007570905B2

(12) United States Patent
Kusaba et al.

(10) Patent No.: US 7,570,905 B2
(45) Date of Patent: Aug. 4, 2009

(54) DEVELOPING ROLLER, DEVELOPING APPARATUS USING THE SAME, AND IMAGE FORMING APPARATUS

(75) Inventors: Takashi Kusaba, Suntou-gun (JP); Ryota Kashiwabara, Susono (JP); Minoru Nakamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/061,385

(22) Filed: Apr. 2, 2008

(65) Prior Publication Data

US 2008/0193172 A1 Aug. 14, 2008

Related U.S. Application Data

(63) Continuation of application No. PCT/JP2007/068004, filed on Sep. 10, 2007.

(30) Foreign Application Priority Data

Oct. 6, 2006 (JP) ..... 2006-275524

(51) Int. Cl.
*G03G 15/08* (2006.01)

(52) U.S. Cl. ..... 399/286; 430/123.3

(58) Field of Classification Search ..... 399/286, 399/285, 279

See application file for complete search history.

(56) References Cited

U.S. PATENT DOCUMENTS

| | | | | |
|---|---|---|---|---|
| 4,797,339 | A | 1/1989 | Maruyama et al. | |
| 4,996,127 | A | 2/1991 | Hasegawa et al. | |
| 5,618,647 | A | 4/1997 | Kukimoto et al. | |
| 5,966,578 | A | 10/1999 | Soutome et al. | 399/333 |
| 6,321,062 | B1 | 11/2001 | Kitano et al. | 399/333 |
| 6,360,069 | B1 | 3/2002 | Mimura et al. | |
| 6,377,777 | B1 | 4/2002 | Kishino et al. | 399/329 |
| 6,424,815 | B1 | 7/2002 | Kawamoto et al. | 399/325 |
| 6,459,878 | B1 | 10/2002 | Tomoyuki et al. | 399/331 |
| 6,546,223 | B2 | 4/2003 | Kishino et al. | 399/333 |
| 6,862,424 | B2 | 3/2005 | Matsunaka et al. | 399/333 |
| 7,099,613 | B2 | 8/2006 | Nakamura et al. | |
| 7,127,200 | B2 | 10/2006 | Nakamura et al. | |
| 2003/0232185 | A1 | 12/2003 | Shimamura et al. | |

(Continued)

FOREIGN PATENT DOCUMENTS

| | | |
|---|---|---|
| EP | 0 701 177 A1 | 3/1996 |

(Continued)

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

A developing roller having an elastic layer on the outer periphery of a mandrel and having a surface layer containing a resin and resin particles on its outer periphery, wherein the surface layer has a convex portion attributable to the resin particles, and has a surface of roughness in which a distortion degree Rsk of a roughness curve is 0.15 or more and 0.70 or less, wherein the resin particles have a peak P1 at a particle diameter d1 in a volume particle size distribution, and wherein "a", "b", "c", d1, d2 and d3 satisfy a specific relationship, where, "a" denotes a volume fraction of the resin particle having the particle diameter d1 in the volume particle size distribution, and "b" and "c" denote volume fractions at particle diameters d2 and d3 respectively in the volume particle size distribution.

11 Claims, 8 Drawing Sheets

U.S. PATENT DOCUMENTS

| | | | |
|---|---|---|---|
| 2004/0170449 | A1 | 9/2004 | Sakata et al. |
| 2005/0078986 | A1 | 4/2005 | Nakamura et al. |
| 2006/0275598 | A1 | 12/2006 | Shimamura et al. |

FOREIGN PATENT DOCUMENTS

| | | | |
|---|---|---|---|
| JP | 36-10231 | | 7/1961 |
| JP | 57-5047 | A | 1/1982 |
| JP | 59-61842 | A | 4/1984 |
| JP | 62-106473 | A | 5/1987 |
| JP | 63-186253 | A | 8/1988 |
| JP | 59-53856 | A | 3/1994 |
| JP | 8-184990 | A | 7/1996 |
| JP | 9-106173 | A | 4/1997 |
| JP | 11-212354 | A | 8/1999 |
| JP | 2000-112212 | A | 4/2000 |
| JP | 2003-323041 | A | 11/2003 |
| JP | 2004-191561 | A | 7/2004 |
| JP | 2005-115265 | A | 4/2005 |
| JP | 2005-258201 | A | 9/2005 |
| JP | 2005-352017 | A | 12/2005 |
| JP | 2006-30456 | A | 2/2006 |
| JP | 2006-106198 | A | 4/2006 |

Rsk >> 0

Rsk ≈ 0

Rsk << 0

DEVELOPING ROLLER, DEVELOPING APPARATUS USING THE SAME, AND IMAGE FORMING APPARATUS

This application is a continuation of International Application No. PCT/JP2007/068004, filed Sep. 10, 2007, which claims the benefit of Japanese Patent Application No. 2006-275524, filed Oct. 6, 2006.

BACKGROUND OF THE INVENTION

1. Field of the Invention

The present invention relates to a developing roller, a developing apparatus using the developing roller, and the image forming apparatus, which are used in an image forming apparatus and the like such as a copying machine and a laser printer.

2. Description of the Related Art

In a copying machine using an electrophotographic system, a facsimile, and a printer, a photosensitive member is uniformly charged by a charging roller, thereby forming an electrostatic latent image by a laser and the like. Next, a developer inside a developing container is uniformly coated on the developing roller at a proper charge by a developer coating roller and a developer controlling member, and a transfer (developing) of the developer is performed at a contact portion with the photosensitive member and the developing roller. After that, the developer on the photosensitive member is transferred on a recording paper by a transfer roller, and is fixed by heat and pressure, and the developer remaining on the photosensitive member is removed by a cleaning blade, thereby completing a series of the processes.

As the characteristics required for these developing rollers used for the image forming apparatus, (1) a uniform and high electrostatic property toward the developer, and (2) a uniform developer conveying property are cited.

In the developing roller having a shaft, an elastic layer formed on the outer periphery of the shaft, and at least one layer of a resin coated layer formed on the outer periphery of the elastic layer, it is proposed to improve the above-described characteristics by diffusing various fine particles into the resin coated layer (Japanese Patent Application Laid-Open Nos. 2004-191561, 2005-258201, 2005-115265, and H11-212354).

Now, accompanied with the recent high quality image of the image forming apparatus, the developer used in the image forming apparatus has advanced in making the particle diameter extremely small. To make the average particle diameter of the developer extremely small is an effective means to improve particularly granularity and character reproducibility from among the image quality characteristics. However, much needs to be improved in a specific image quality item, particularly, a fog and a stripe-like image defect (hereinafter, referred to as resulting stripe from development) at the continuous printing time.

That is, when the developer is made into an extremely small particle, the number of contacts/collisions of the fellow developers or the developer with the developing roller and the developer controlling member is increased, and the developer is liable to deteriorate. The deteriorated developer is easily fused on the surfaces of the developing roller and the developer controlling member. The developing roller fused with the deteriorated developer on the surface is reduced in the charge imparting amount to the developer, and as a result, the fog is often generated in the electrophotographic image. Further, when the deteriorated developer is partially fused on the surface of the developer controlling member, a coating amount of the developer on the developing roller is liable to be non-uniform. As a result, the resulting stripe from development is often generated in the electrophotographic image.

Further, in the recent years, even in a color image forming apparatus having many outputs of so-called solid images, further uniformity of the image and elevated concentration of the image density are required.

For such requirement, a developing apparatus is proposed in which a bias is applied on a developing blade for regulating an amount of the developer on the developing roller (for example, Japanese Patent Application Laid-Open No. 2000-112212).

However, by applying a bias on the developer controlling member (developing blade), similarly to a case of making the particle diameter of the toner extremely small, the generation of the fog and the resulting stripe from development at a continuous printing time has become often conspicuous. That is, the application of the bias on the developing blade increases a stress given to the developer, and the fusion of the developer and an external additive of the developer on the developing roller surface and the developing blade easily generate the fog and the resulting stripe from development.

As described above, as a result of repeated examinations in consideration of the recent technical trend such as making the developer extremely small and applying a bias on the developing blade, in which the fog and the resulting stripe from development are easily generated on the electrophotographic image, it was found that the developing rollers proposed heretofore such as disclosed in Japanese Patent application Laid-Open Nos. 2004-191561, 2005-258201, 2005-115265, and H11-212354 had often generated the fog and the resulting stripe from development on the electrophotographic image particularly at the continuous printing time in the low temperature and low-humidity environment.

SUMMARY OF THE INVENTION

An object of the present invention is to provide a developing roller improved in the fog and the resulting stripe from development at the continuous printing time, and moreover, to provide a developing apparatus and an image forming apparatus of high image quality using such a developing roller.

As a result of repeated examinations on an elastic resin particle added in the surface layer of the developing roller and the surface state, the present inventor and others have found that a developing roller, a developing apparatus, and an image forming apparatus capable of achieving the above-described objects can be obtained.

According to one aspect of the present invention, there is provided a developing roller having an elastic layer on the outer periphery of a mandrel and having a surface layer containing a resin and resin particles on its outer periphery, wherein the surface layer has a convex portion attributable to the resin particles, and has a surface roughness in which a distortion degree Rsk of a roughness curve is 0.15 or more and 0.70 or less, wherein the resin particles have a peak P1 at a particle diameter d1 in a volume particle size distribution, and wherein "a", "b", "c", d1, d2 and d3 satisfy the following relational formulas (1) to (7):

$$4\ \mu m \leqq d2 - d1 \leqq 12\ \mu m \quad (1)$$

$$6\ \mu m \leqq d1 \leqq 22\ \mu m \quad (2)$$

$$10\ \mu m \leqq d2 \leqq 27\ \mu m \quad (3)$$

$$2.0\ \text{Vol.}\ \% \leqq b \leqq 8.0\ \text{Vol.}\ \% \quad (4)$$

$$1.5 \leqq a/b \leqq 7.0 \quad (5)$$

$$0.0 \leqq c/b \leqq 1.1 \quad (6)$$

$$d1 < d3 < d2 \quad (7)$$

where, "a" denotes a volume fraction of the resin particle having the particle diameter d1 in the volume particle size distribution, and "b" and "c" denote volume fractions at particle diameters d2 and d3 respectively in the volume particle size distribution.

According to another aspect of the present invention, there is provided a developing apparatus, comprising at least a monocomponent dry developer, the developing roller as described above, and a developing blade for controlling the amount of the developer on the developing roller.

According to a further aspect of the present invention, there is provided an image forming apparatus, comprising at least a developing roller as described above carrying a developer on the surface thereof, and a developing blade for controlling the amount of the developer on the developing roller.

According to the present invention, a developing roller can be provided in which a fog and a resulting stripe from development at a continuous printing time are improved, and a developing apparatus and an image forming apparatus capable of stably forming a high quality image can be provided.

Further features of the present invention will become apparent from the following description of exemplary embodiments with reference to the attached drawings.

DESCRIPTION OF THE EMBODIMENTS

As a result of various examinations to achieve the above-described object, knowledge was obtained about the necessity of reducing contact points between the developing roller and the developer controlling member (developing blade) in order to improve the resulting stripe from development. That is, it was found necessary to make a distortion degree Rsk of the roughness curve of the surface roughness of the developing roller large.

On the other hand, knowledge was obtained that it is favorable not to allow the developer to be accumulated on the developing roller in order to improve a fog when the developing roller surface is scraped by the developing blade. That is, it was found favorable to approximate the distortion degree of the roughness curve of the surface roughness of the developing roller, that is, Rsk to zero.

Here, the distortion degree of the roughness curve of the surface roughness of the developing roller will be described by using FIGS. 3A to 3E and FIGS. 4A to 4D. FIGS. 3A to 3E are cross-sectional schematic diagrams of the developing roller surface vicinity, and on the outer periphery of an elastic layer 2, a surface layer 3 is disposed. Further, in the surface layer 3, a urethane resin particle 31 having a relative large particle diameter and a urethane resin particle 32 having a relatively small particle diameter are dispersed and contained. FIGS. 4A to 4D are schematic illustrations of the roughness curve of the surface roughness of the developing roller, and the horizontal direction of the figure shows an axial direction of the developing roller surface, and the vertical direction of the figure shows a roughness shape of the developing roller. FIGS. 4A, 4B, and 4C are examples of the roughness curve in the case of Rsk>0, Rsk≈0, and Rsk<0, respectively.

Figure 3A:
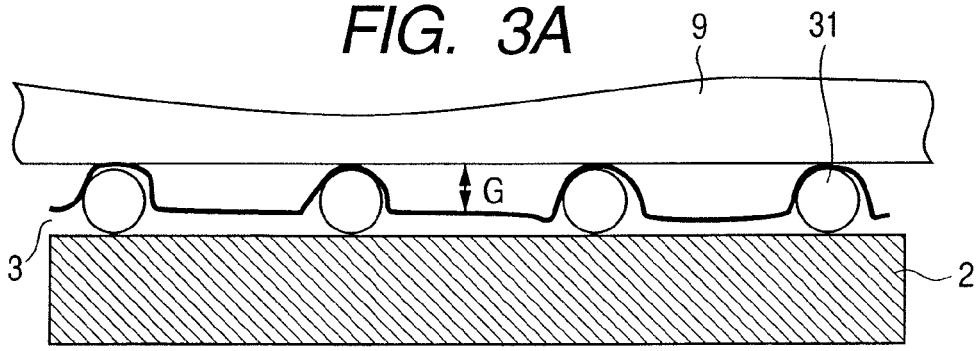
FIGS. 3A, 3B, 3C, 3D, and 3E are schematic views illustrating a developing roller surface vicinity state according to the present invention.
Figure 4A:
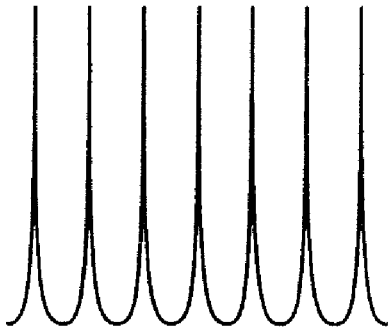
FIGS. 4A, 4B, 4C, and 4D are schematic views illustrating a distortion degree of a roughness curve in the surface roughness.
Figure 4B:
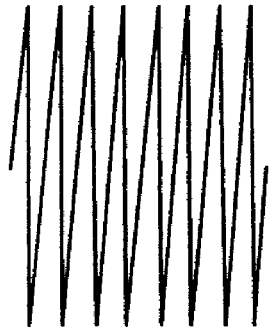
Figure 4C:
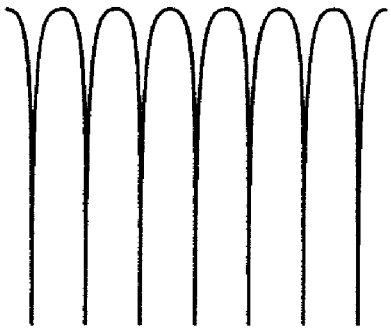

That is, as shown in FIG. 3A, when a small quantity of the large particle is contained in the developing roller surface layer, the roughness curve in the developing roller surface roughness shows a profile as shown in FIG. 4A, and the value of the distortion degree Rsk of the roughness curve becomes larger than zero.

Figure 3B:
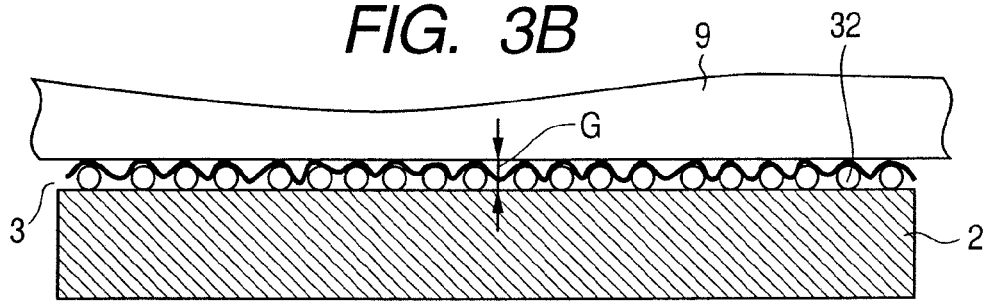

On the other hand, as shown in FIG. 3B, when a large quantity of the particles is contained in the developing roller surface layer, the roughness curve in the developing roller surface roughness shows a profile as shown in FIG. 4B, and the value of the distortion degree Rsk of the roughness curve becomes approximately zero.

Further, the roughness curve when a micro concavity exists in the developing roller surface shows a profile as shown in FIG. 4C.

Figure 3C:
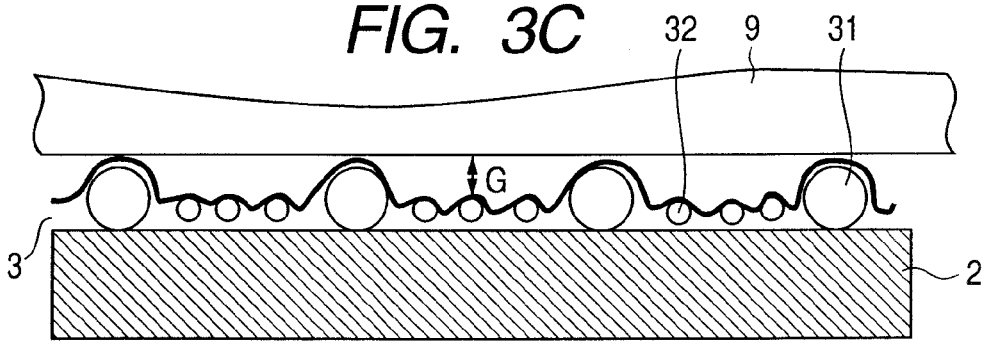
Figure 4D:
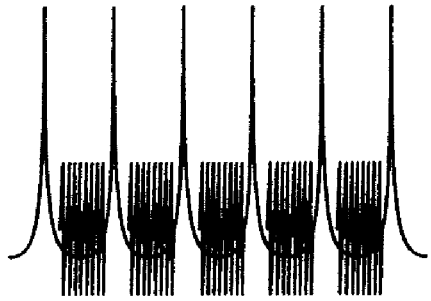

Further, as shown in FIG. 3C, when the particles having a relatively large particle diameter and a relatively small particle diameter are simultaneously contained in the developing roller surface layer, the roughness curve in the surface roughness of the developing roller shows a profile as shown in FIG. 4D.

That is, in the case of the configuration as shown FIG. 3A in which a small quantity of the large sized particles is added in the developing roller surface layer, the value of Rsk can be made large. When Rsk serving as a parameter to represent an acutance of the roughness curve is taken as 0.15 or more and 0.70 or less, Rsk can appropriately sharpen the protrusions of the surface. As a result, the contact point or the contact area with the developing blade and the developing roller surface can be reduced, while maintaining a charging capability of the developer, and it is considered that the deterioration of the developer can be effectively suppressed. For this reason, it is considered that the resulting stripe from development is improved.

On the other hand, when there exist many portions, which are particle-free portions whose surfaces are not roughened, fluidity of the developer on the developing roller surface is reduced.

Further, when a gap (G of FIGS. 3A to 3E) formed by the surface layer 3 of the developing roller 6 and a regulatory blade 9 becomes large, even when the developer is rubbed by the regulatory blade, the developer is accumulated inside the gap in the vicinity of the developer roller surface, so that the fog may be deteriorated.

By setting the configuration such as shown in FIG. 3B, in which a large quantity of the particles is added on the developing roller surface layer, and minutely roughening the developing roller surface, the developer is prevented from being accumulated on the developing roller, thereby improving the fog.

However, when the configuration is set in such a manner, the number of contact points with the developing roller and the developer controlling member (developing blade) increases, and the resulting stripe from development is relatively deteriorated.

Hence, the present inventors and others have further conducted examinations on the particle size distribution of the particle to be added and the particle diameter, and found that the following requirements are necessary to improve both the fog and the resulting stripe from development concurrently.

1) To configure so as to contain a relatively large particle in a specific particle diameter range concurrently with a relatively small particle in a specific particle diameter range in the surface layer as shown in FIG. 3C.

2) To control Rsk in a predetermined numerical value range.

Hereinafter, the present invention will be described further in detail.

Figure 1:
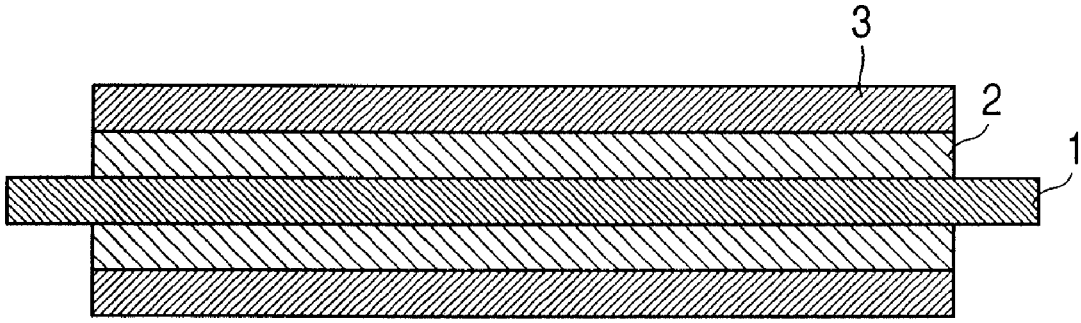
FIG. 1 is a cross-sectional view in an axial direction showing one example of a developing roller according to the present invention.
Figure 2A:
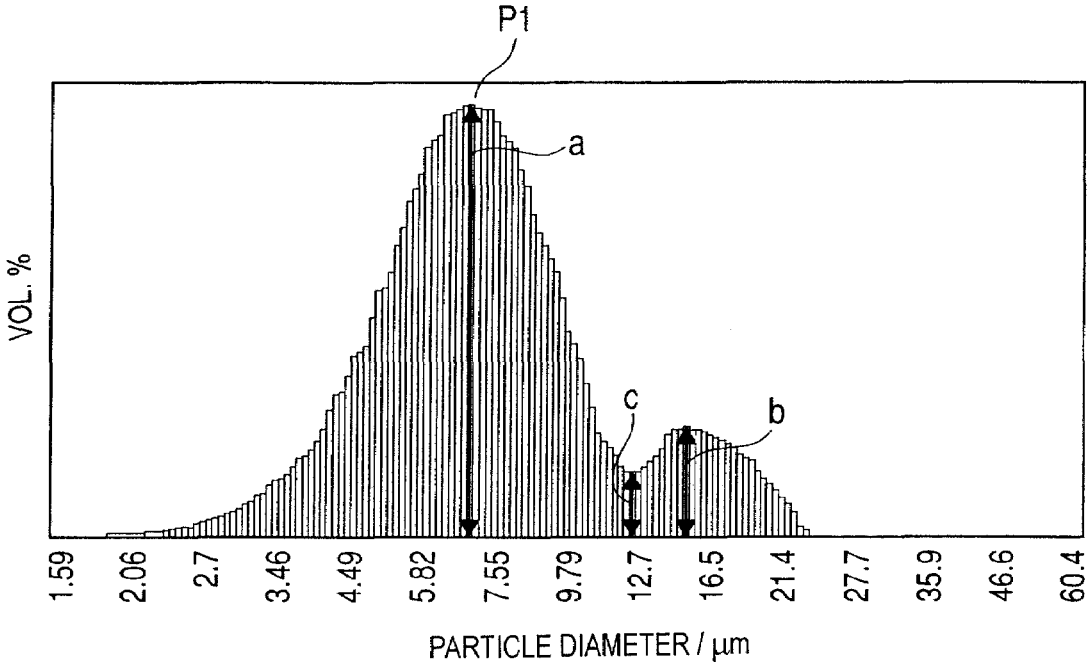
FIGS. 2A and 2B are views illustrating a peak of volume particle size distribution of a spherical urethane resin particle according to the present invention.
Figure 2B:
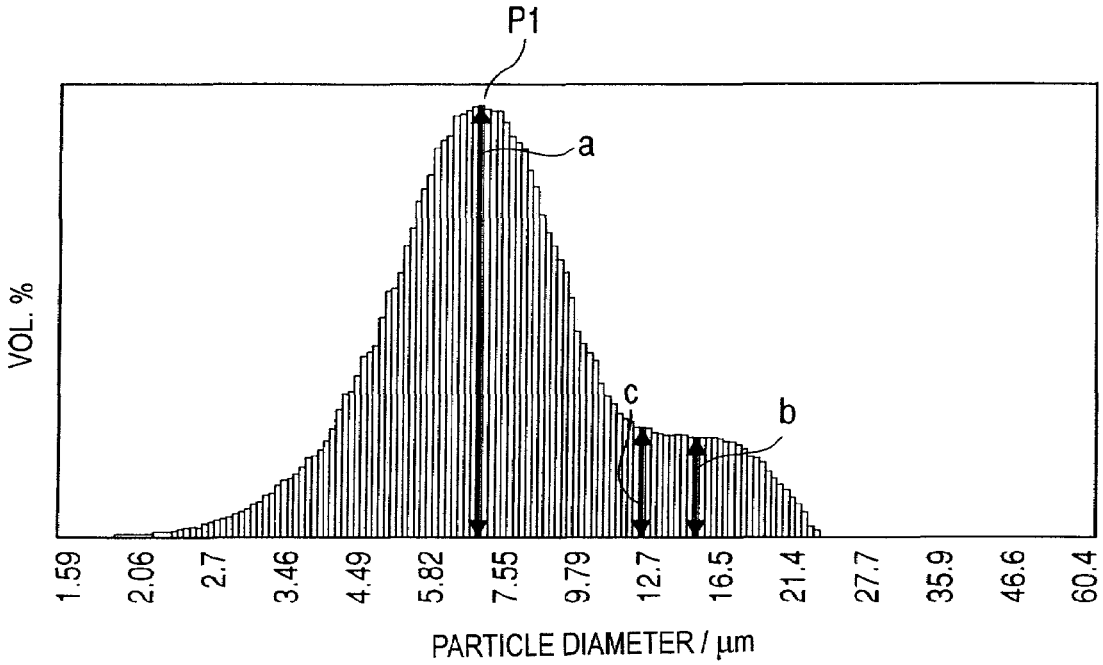

The developing roller according to the present invention, as shown in FIG. 1, includes a mandrel 1, an elastic layer 2 in the outer periphery of the mandrel, and a surface layer 3 on the outer periphery of the elastic layer.

The surface layer includes a resin and a resin particle dispersed into the resin. Further, the surface layer has a convex portion attributable to the resin particle on the surface. Further, the surface layer has a surface roughness in which a distortion degree (hereinafter, referred to also as "Rsk")of a roughness curve is 0.15 or more and 0.70 or less.

The resin particle which is a rough particle allowing the surface layer to bear a convex portion has a peak P1 in a particle diameter d1 in a volume particle size distribution. When a volume fraction of total resin particles of the particle having a particle diameter d1 is taken as a, and moreover, volume fractions of total resin particles of the resin particle having particle diameters d2 and d3 larger than d1 are taken as b and c, d1, d2, d3 and a, b, and c satisfy the following relational formulas (1) to (7).

$$4\ \mu m \leqq d2-d1 \leqq 12\ \mu m \quad (1)$$

$$6\ \mu m \leqq d1 \leqq 22\ \mu m \quad (2)$$

$$10\ \mu m \leqq d2 \leqq 27\ \mu m \quad (3)$$

$$2.0\ \text{Vol.}\ \% \leqq b \leqq 8.0\ \text{Vol.}\ \% \quad (4)$$

$$1.5 \leqq a/b \leqq 7.0 \quad (5)$$

$$0.0 \leqq c/b \leqq 1.1 \quad (6)$$

$$d1 \leqq d3 \leqq d2 \quad (7)$$

By adopting such a configuration, the above-described problem, that is, both of the fog and the resulting stripe from development can be improved at the same time.

FIG. 3C illustrates a cross-sectional schematic diagram of the surface vicinity of the developing roller according to one aspect of the present invention. On the outer periphery of the elastic layer 2, the surface layer 3 is disposed. The surface layer 3 is made of a urethane resin which is a binder resin, a urethane resin particle 31 dispersed in the urethane resin, and a urethane resin particle 32 dispersed in the urethane resin and relatively small in particle diameter as compared with the urethane resin particle 31. By the urethane resin particles 31 and 32, a convex portion is formed on the surface of the surface layer.

The urethane resin particle satisfies the above-described formulas (1) to (7) in the volume particle size distribution, and is in the numeral value range of 0.15 or more and 0.70 or less and particularly 0.3 or more and 0.60 or less in Rsk of the surface of the surface layer.

Rsk is an index of acutance of the convex portion forming the surface roughness, and by defining Rsk, the contact state (contact point, contact area, and the like) with the regulatory blade and the developing roller can be specified. When Rsk is set within the above-described numerical value, the generation of the resulting stripe from development in the electrophotographic image can be remarkably improved. This is because it is considered that the deterioration of the developer in the contact place with the regulatory blade and the developing roller can be suppressed.

Further, by satisfying the above-described relationship, the generation of the fog on the electrophotographic image can be remarkably suppressed. This is because it is considered that, as illustrated in FIG. 3C, the portion of the surface layer 3 that is free of the relatively large urethane resin particles 31 is minutely roughened by the relatively small urethane resin particle 32, thereby enabling the accumulation of the developer to be suppressed.

As described above, by the developing roller according to the present invention, both the generation of the fog on the electrophotographic image and the generation of the resulting stripe from development can be extremely effectively improved.

The measuring method of the volume particle size distribution of the resin particle in the developing roller of the present invention will be shown below (Measuring Method of Volume Particle Size Distribution of Resin Particles)

First, the surface layer was carved out from the developing roller. The carved out surface layer was torn apart and broken by an appropriate method, and the broken surface is observed by an optical enlargement observing means such as a video microscope. An observing enlargement ratio is preferably 500 to 2000 times.

One thousand urethane particles only whose profile lines are observable from the observed broken surface are selected. On each of the selected urethane resin particles, R (μm): a diameter equivalent to the surface area (diameter of a circle having the surface area equal to a projected area) is determined.

Since the resin particles used in the present invention are basically spherical, the volume: Vn ($\mu m^3$) of each urethane resin particle can be calculated by the formula (14).

$$Vn=(4\pi/3)\cdot(R/2)^3 \quad (14)$$

(provided that n is an integer of 1 to 1000)

On each of the selected 1000 urethane particles, the volume: Vn (n is an integer of 1 to 1000 of the resin particle is determined.

From Vn obtained from the above-described operations, a histogram is prepared, in which the axis of abscissas shows the particle diameter (μm) and the axis of ordinate shows a volume fraction. The preparation of the histogram is made as follows.

First, the axis of abscissas of the histogram is R (μm): a diameter equivalent to the surface area of the resin particle. The hierarchy of the histogram divides a zone from 1.59 μm to 64 μm into 32 by a geometric progression.

That is, the hierarchical value (separating value of the hierarchy): Xm (μm) is shown by the formula (15).

$$Xm = 1.59 \times \left( \sqrt[32]{\frac{64}{1.59}} \right)^{m-1} \quad (15)$$

(provided that m is an integer of 1 to 33)

A value whose total sum of the volumes of the resin particles belonging to each hierarchy of the histogram is divided by a total sum of the volumes of 1000 resin particles shown by the following formula is taken as a value of the axis of ordinate of the histogram in its hierarchy.

$$\sum_{n=1}^{1000} Vn$$

In the manner as described above, the volume particle size distribution of 1000 resin particles is shown by the histogram.

In the above-described histogram, the particle diameter RSj (μm) (provided that j is an integer of 1 to 32) of each hierarchy is determined according to the formula (16), and RSj is defined as a representative particle diameter in its hierarchy. That is, the axis of ordinate of the histogram is a volume fraction of total particles of some representative particle diameter.

$$RSj=(X_{m1}+X_m)/2 \quad (16)$$

(provided that j=n, and j is an integer of 1 to 32).

From the histogram showing the volume particle size distribution, the deciding method of the particle diameters d1, d2, and d3 in the present invention will be shown below.

(Deciding Method of d1, d2, and d3 in Volume Particle Size Distribution of Resin Particles)

(Deciding Method of d1)

The representative particle diameter of the hierarchy showing the maximum and the greatest value in the axis of ordinate of the histogram is taken as d1 (μm).

(Deciding Method of d2 and d3)

(In case that a maximum value in the axis of ordinate of the histogram at a particle diameter larger than d1, exists.)

In the case that one or more hierarchies showing the maximum value in the axis of ordinate of the histogram, and having a representative particle diameter larger than d1 exists, the representative particle diameter which is the greatest among respective representative particle diameters of the hierarchies showing the maximum values, is taken as d2 (μm). The hierarchy at d2 thus decided becomes a peak P2 in the present invention.

Further, d3 (μm) shows a representative diameter of the hierarchy showing the minimum and the smallest value in axis of ordinate of the histogram between the representative particle diameters d1 and d2 of the histogram.

(In case that no maximum value in the axis of ordinate of the histogram at a particle diameter larger than d1)

On the other hand, in the case that no maximum value in the axis of ordinate of the histogram having representative particle diameters of the histogram larger than d1 exists, by performing the following operation, d2 and d3 are decided.

The representative particle diameter of the hierarchy having the representative particle diameter larger than d1 is taken as R1, R2, . . . Rx in the increasing order of the representative particle diameter (provided that x is an integer of 1 or more). Next, the value of the axis of ordinate of the histogram of the hierarchy having the representative particle diameter larger than d1 is taken as Ax, and the Ax and the additive arithmetic mean value of the values (Ax−1 and Ax+1) of the axis of ordinates in the hierarchies of both adjacent sides are compared. That is, in a graph plotting the representative particle diameter Rx in the axis of abscissas and a value of Bx determined by the formula (17) in the axis of ordinate, the representative particle diameter Rx showing the maximum value is taken as d2 (μm) in the present invention. Further, when a plurality of the maximum values are present in the graph, Rx which is the greatest in the representative particle diameter is taken as d2 (μm). The hierarchy in d2 thus decided becomes a peak P2 in the present invention.

Further, in the graph plotting the representative particle diameter Rx in the axis of abscissas and the value of Bx determined by formula (17) in the axis of ordinate, the representative particle diameter Rx showing the minimum value which is present between the representative particle diameters d1 and d2 is taken as d3 (μn). When a plurality of representative particle diameters which become the minimum values is present in the graph, from among the representative particle diameters which become the minimum values, the representative particle diameter which becomes the smallest in the axis of ordinate of the histogram is taken as d3 (μm).

$$Bx=Ax-(Ax+1+Ax-1)/2 \quad (17)$$

(provided that x is an integer of 1 or more)

(Deciding Method of a, b, and c)

Further, the volume fraction of the representative particle diameters d1, d2, and d3 thus decided of total particles is read from the histogram showing the volume particle size distribution, and each of them is taken as a, b, and c.

(Measuring Method of Distortion Degree Rsk of Roughness Curve)

The distortion degree Rsk of the developing roller surface roughness curve in the present invention was measured in conformity to Japan Industrial Standard (JIS) B0601-2001. A specific measuring method will be shown below.

The developing roller was kept still standing for 24 hours in the environment of the temperature 23° C./humidity 55% Rh. Subsequently, in the environment of the temperature 23° C./humidity 55% Rh, the distortion degree Rsk of the roughness curve of the surface roughness was measured with respect to the axial direction of the developing roller by using a contact type surface roughness gauge (Product name: SE-3500; made by Kosaka Laboratory Ltd).

The location of measurement was measured as shown below by measuring a total of 12 points of 3 points of the center portion in the axial direction×4 points in the peripheral direction, and the average value of these 12 points was taken as a value of the distortion degree Rsk of the roughness curve of the developing roller surface roughness. The location of measurement and the measurement conditions are shown below. With respect to the total of 12 points of three points of the center portion in the axial direction and each location 30 mm inside both end portions in the axial direction by every angle of 90 degrees in the peripheral direction, the developing roller was measured in the axial direction, and its average value was taken as a value of Rsk of the developing roller. The measurement conditions are shown below.

(Measurement Position)

Axial direction: three points of the center portion in the axial direction of the developing roller and each location 30 mm inside both end portions in the axial direction of the developing roller.

Peripheral direction: with respect to three points each in the axial direction, every angle of 90 degrees in the peripheral direction (Measurement Condition)

Measurement direction: the developing roller axial direction

Cut Off: 0.8 mm

Filter: 2CR

Estimation Length: 4 mm

Measurement speed: 1 mm/sec.

Here, in the volume particle size distribution of the resin particle, in the case of the following (aa), (ab) or (ac) and when the value of Rsk exceeds 0.70, a gap formed by the developing roller surface and the regulatory blade as illustrated in G of FIG. 3C becomes excessively large, and the developer may be accumulated inside the gap.

(aa) When d2 exceeds 27 μm (ab) When a particle diameter difference between d1 and d2 exceeds 12 μm (ac) When b exceeds 8.0 vol. %

Further, in the volume particle size distribution of the resin particle, in the case of the following (ad) and (ae) or (af), inside the gap formed by the developing roller surface and the regulatory blade as illustrated by G of FIG. 3C, the contact area of the developing roller surface and the developer is increased, so that the accumulation of the developer is generated.

Figure 3D:
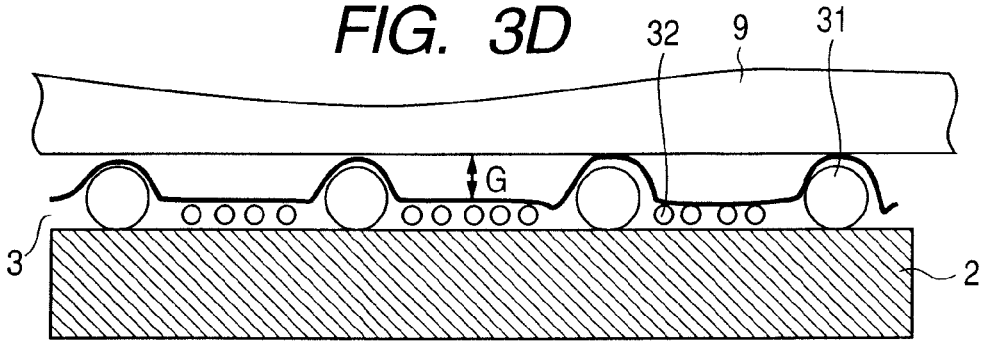

(ad) When d1 is below 6 μm, the particle as illustrated by 32 of FIG. 3C is too small, so that the vicinity of the developer surface becomes as illustrated in FIG. 3D, and the portion of the surface layer that is free of the relatively large particles 31 is unable to be rough-surfaced.

(ae) When the value of a/b is below 1.5, a percentage content of the particle as illustrated by 32 in FIG. 3C is low, so that the developing roller surface is unable to be minutely rough-surfaced.

Figure 3E:
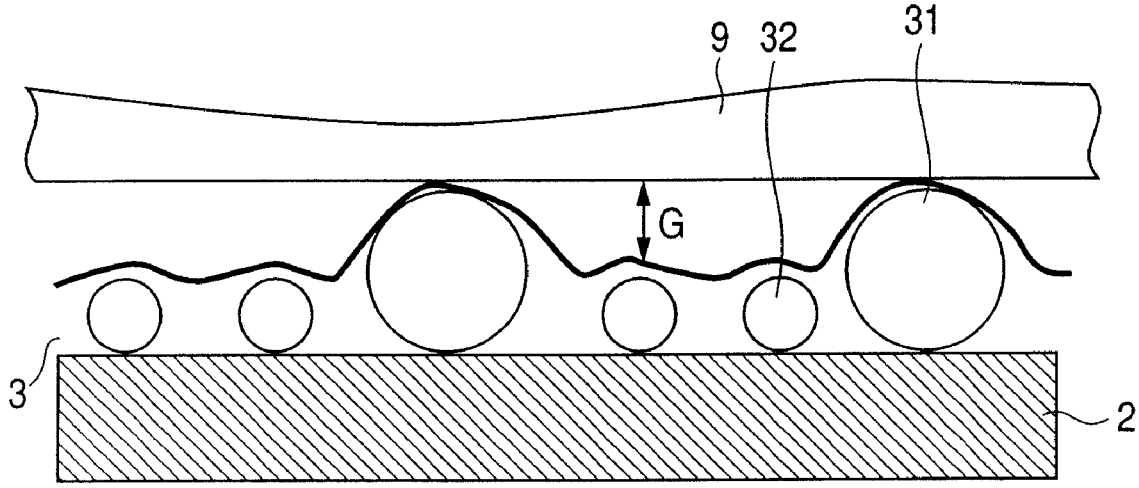

(af) When d1 exceeds 22 μm, the vicinity of the developer surface becomes as illustrated in FIG. 3E, and because the particle as illustrated by 32 is large and a curvature of the particle is small, the particle-free portion of the relatively large particle 31 is unable to be minutely rough-surfaced.

By the above-described factor, when the accumulation of the developer is generated in the gap formed by the developing roller surface as illustrated by G of FIGS. 3A to 3E and the regulatory blade, the developer is sometimes crushed while being repeatedly rubbed with the member such as the photosensitive drum, a developer supplying member, and the like. As a result, the developer is fused on the developing roller surface, so that the fog may be generated on the electrophotographic image.

On the other hand, in the volume particle size distribution of the resin particle, in the case of the following (ag), (ah), (ai) or (ak) and when the value of Rsk is below 0.15, the gap illustrated by G of FIG. 3C becomes extremely small.

(ag) When d2 is below 10 μm (ah) When a particle diameter difference d2−d1 between d1 and d2 is below 4 μm (ai) When the value of a/b exceeds 7.0

(aj) When b is below 2.0 vol. %

(ak) when the value of c/b exceeds 1.1

In such a case, the contact portion between the developing roller and the regulatory blade is increased, so that the resulting stripe from development is liable to occur.

Here, in the present invention, when the urethane resin is used for the binder resin of the surface layer, the urethane resin particle is preferably used for the resin particle.

This is because the resin particle is not dropped from inside the binder resin due to endurance, so that the surface profile of the developing roller and the gap do not change.

(Mandrel)

In the present invention, as the mandrel 1, as far as having a good conductivity, any one of them can be used. Usually, a cylindrical body or a columnar body made of metal, for example, such as aluminum, iron, and stainless (SUS) is used. The outer diameters of the cylindrical body and the columnar body are, for example, 4 to 10 mm.

(Elastic Layer)

Next, a conductive elastic layer 2 formed on the outer periphery of the mandrel 1 will be described. The layer uses elastomer such as a silicone rubber, EPDM or urethane or other resin compacts as a substrate. This substrate is blended with an electronic conductive substance such as carbon black, metal, and metal oxide and an ion conductive substance such as sodium perchlorate. By the blending of the electronic conductive substance and the ion conductive substance, the substrate is adjusted to an appropriate resistance region $10^3$ to $10^{10}$ Ω cm, and preferably $10^4$ to $10^8$ Ω cm. At this time, a hardness of the elastic layer is preferably taken as ASKER-C hardness 25 to 60 degrees.

An example of the material of the substrate of the elastic layer 2, the following is included.

Polyurethane, natural rubber, butyl rubber, nitrile rubber, polyisoprene rubber, polybutadiene rubber, silicone rubber, styrene-butadiene rubber, ethylene-propylene rubber, ethylene-propylene-diene rubber, chioroprene rubber, acryl rubber, and mixture of these rubbers and the like.

From among these rubbers, because of having peculiar characteristics such as low hardness and high impact resilience, silicone rubber is preferably used.

(Binder Resin of Surface Layer)

As the binder resin of the surface layer 3 formed on the outer periphery of the elastic layer, a polyurethane resin is preferable in view of electrostatic property and abrasion resistance of the toner. The polyetherpolyurethane resin is particularly preferable because the hardness of the surface layer can be reduced and a charging ability of the toner is high.

A polyetherpolyurethane resin can be obtained by the reaction with publicly known polyether polyol and isocyanate compound. As polyetherpolyol, for example, polyethyleneglycol, polyplopylenegycol, polytetramethyleneglycol, and the like can be cited. Further, these polyol components may be made into chain-extended pre-polymers in advance according to need by isocyanate such as 2,4-tolylene diisocyanate (TDI), 1,4-diphenylmethane diisocyanate (MDI), isophorone diisocyanate (IPDI), and the like.

An example of the isocyanate compound reacted with these polyol components includes the following.

- Aliphatic polyisocyanate such as ethylenediisocyanate, 1,6-hexamethylenediisocyanate (HDI);
- Alicyclic polyisocyanate such as isophorone diisocyanate (IPDI), cyclohexane 1,3-diisocyanate, cyclohexane 1,4-diisocyanate, and the like;
- Aromatic polyisocyanate such as 2,4-tolylenediisocyanate, 2,6-tolylenediisocyanate TDI), diphenylmethane diisocyanate (MDI); and
- Modified material of the above, copolymer, and block copolymer.

However, the example is not limited to these isocyanate compounds.

(Resin Particle)

As the resin particle contained in the surface layer 3, a spherical resin particle is preferable. Further, the urethane resin particle is preferable in view of adhesiveness with the binder resin and charge imparting property to the toner.

Further, as described above, in view of the fog and resulting stripe from development, if the spherical urethane resin particle satisfies the relational formulas (1) to (7) in the volume particle size distribution, the urethane resin particle to be contained may be single or mixed plurally.

Further, to control the volume particle size distribution of the resin particle, the resin particle may be classified. Here, a classifier is not particularly limited. For example, an ordinary classifier such as a sieving machine, a gravitational classifier, a centrifugal classifier, and an inertia classifier can be used. Particularly, using a wind classifier such as a gravitational classifier, a centrifugal classifier, and an inertia classifier is preferable. This is because the productivity is good and the change of classification point can be easily performed.

Further, in the developing roller surface layer, it is preferable that the following formulas (8) to (10) are satisfied. A blending quantity of the resin particle to 100 parts by mass of the urethane resin is taken as a [mass part] A. A thickness of the surface layer is taken as t[μm]. Further, in the volume particle size distribution of the spherical urethane resin particle, a ratio of the particle of the particle diameter not less than 1.2 times the thickness of the surface layer is taken as B[%]. As a result, in the surface roughness of the developing roller, the distortion degree Rsk of the roughness curve can be accurately controlled to 0.15 or more and 0.7 or less.

$$15 \leqq A \leqq 40 \quad (8)$$

$$8.0 \leqq t \leqq 15.0 \quad (9)$$

$$3.0 \leqq A \times B/100 \leqq 9.0 \quad (10)$$

Further, in the surface roughness of the developing roller, since the distortion degree Rsk of the roughness curve can be controlled from 0.3 to 0.6 which is a preferable range of the present invention, it is preferable that t satisfies the formula (11), and A and B satisfy the formula (12).

$$9.0 \leqq t \leqq 12.0 \quad (11)$$

$$3.5 \leqq A \times B/100 \leqq 6.0 \quad (12).$$

Further, by setting the micro rubber hardness of the developing roller surface 30 degrees or more and 38 degrees or less, a depressing effect of the fog can be enhanced. This is because, by appropriately reducing the hardness of the developing roller surface, the damage to the developer can be mitigated.

(Manufacturing Process)

The developing roller according to the present invention forms an elastic layer on the outer periphery of the mandrel. On the outer periphery of the elastic layer, a surface layer is disposed.

The surface layer is obtained by allowing the resin particle of 6 μm or more and 22 μm or less in volume average particle diameter to contain 12 parts by mass or more and 35 parts by mass or less, and the resin particle of 10 μm or more and 27 μm or less in volume average particle diameter to contain 3 parts by mass or more and 15 parts by mass or less based on 100 parts by mass of the binder resin.

Particularly, a surface layer is preferable, which allows the resin particle of 7 μm or more and 10 μm or less in volume average particle diameter to contain 15 parts by mass or more and 25 parts by mass or less, and the resin particle of 12 μm or more and 20 μm or less in volume average particle diameter to contain 5 parts by mass or more and 10 parts by mass or less based on 100 parts by mass of the binder resin.

As the urethane resin particle, any type may be used, but because of excellent dispersibility and stability, a spherical particle made of a cross-linked urethane resin is preferable.

The volume average particle diameter of the urethane resin particle can be measured by a precision particle size distribution measurement device (Product name: Multisizer 2; made by Beckman Coulter, Inc.). The precision particle size distribution measurement device is connected to an interface (made by BIOS CORPORATION) for outputting a number distribution and a volume distribution and a personal computer. As an electrolyte, by using a first class sodium chloride, 1% NaCl aqueous solution is prepared. As the electrolyte, ISOTON (Product Name: R-II, Made by Beckman Coulter, Inc.) and the like may be used. First, 0.1 to 5 ml of a surfactant (preferably alkyl benzene sulfonate) is added into 100 to 150 ml of the electrolyte as a dispersing agent, and further, 2 to 20 mg of a measurement sample is added. The electrolyte having suspended the measurement sample is subjected to distributing processing for approximately one to three minutes by ultrasonic dispersion device. With the electrolyte subjected to ultrasonic processing taken as a measurement sample, the volume particle size distributions of 128 channels are measured in a range of 1.59 μm to 64.00 μm by using the precision particle size distribution measurement device adopting an aperture of 100 μm. A 50% D diameter thus measured is taken as a volume average particle diameter of the spherical urethane resin particle in the present invention.

The developing roller according to the present invention can be obtained by forming an elastic layer on the outer periphery of the mandrel by using a publicly known method and forming a surface layer on the outer periphery thereof by using a publicly known method. Here, though the forming method of the elastic layer is not particularly limited, a method of forming the elastic layer by injecting an elastic substance into a mold may be preferable because, by so doing, the elastic layer can be formed with high dimension accuracy.

Figure 6:
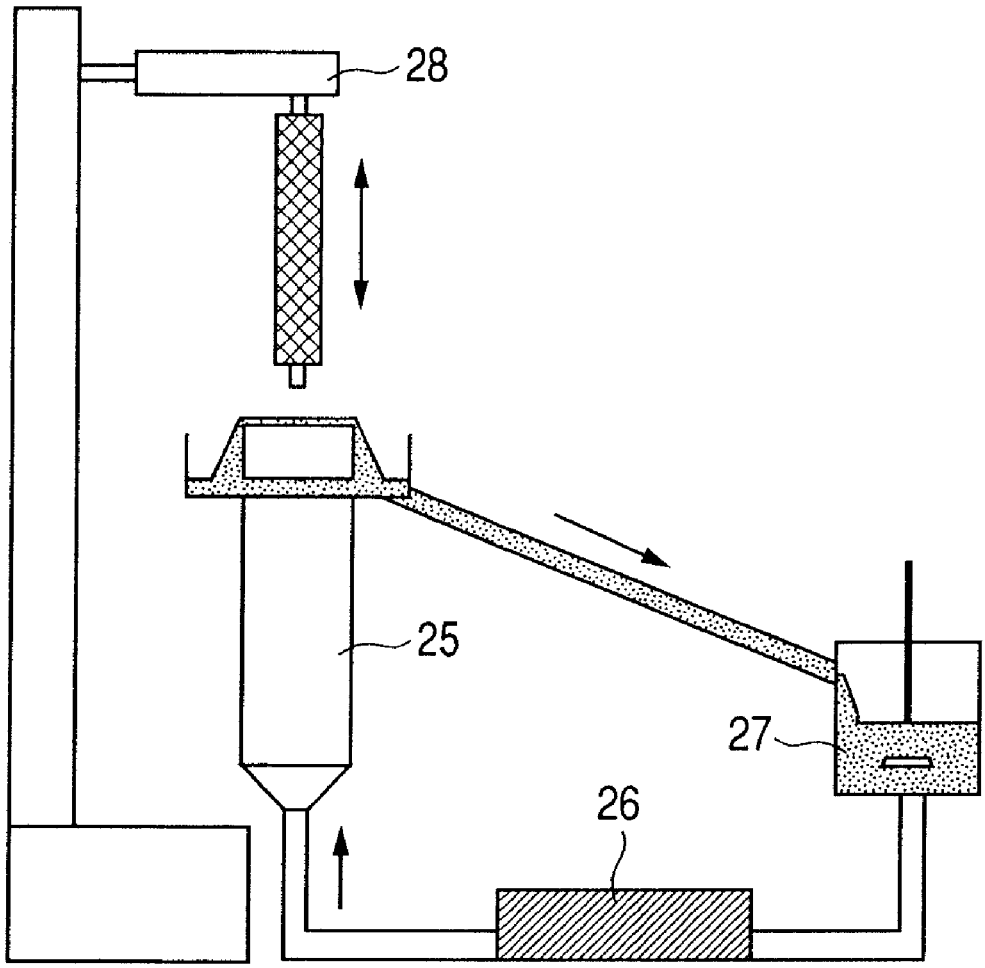
FIG. 6 is a schematic diagram showing one example of an immersion coating machine used when forming a resin layer of the developing roller according to the present invention.

Further, the forming method of the surface layer is neither particularly limited. Because a stabilized surface shape can be obtained, a method of coating a surface layer coating material on the elastic layer is preferable. Particularly, because production stability is excellent, a dip coat method of overflowing the coating material from the upper end of a dipping tank as disclosed in Japanese Patent Application Laid-Open No. S57-005047 is preferable. FIG. 6 is a schematic diagram of the dip coating of an overflow system. Reference numeral 25 denotes a columnar dipping tank, which has an inner diameter larger than a roller outer shape, and has a depth larger than the axial length of the roller. On the upper edge outer periphery of the dipping tank 25, an annular liquid receiving portion is provided, and is connected to an agitating tank 27.

Further, the bottom of the dipping tank 25 is connected to the agitating tank 27, and the coating material in the agitating tank 27 is fed to the bottom of the dipping tank 25 by a liquid feeding pump 26. The coating material fed to the bottom of the dipping tank 25 overflows from the upper end portion of the dipping tank and returns to the agitating tank 27 through the liquid receiving portion of the upper edge outer periphery of the dipping tank 25. A roller member providing the elastic layer 2 on the mandrel 1 is fixed vertically to a lifting device 28, and is dipped into and pulled from the dipping tank 25, thereby forming the resin layer 3.

(Resistance Adjusting Agent)

A conductive material used for adjusting an electric resistance of the elastic layer 2 and the surface layer 3 in the present invention may be either an electronic conductive material or an ion conductive material.

(Electronic Conductive Material)

An example of the electronic conductive material includes the following.

(1) Conductive carbon (for example, Ketjen black EC, acetylene black, and the like).

(2) Rubber carbon, for example, Super Abrasion Furnace (SAF), Intermediate SAF(ISAF), High Abrasion Furnace (HAF), Fast Extrusion Furnace (FEF), General Purpose Furnace (GPF), Semi Reinforcing Furnace (SRF), Fine Thermal (FT), Medium Thermal (MT), and the like.

(3) Color (ink) carbon given oxidation treatment and the like.

(4) Metal such as copper, silver, germanium, and the like, and metal oxide and the like.

From the above-described materials, because of capability of controlling conductivity by a small quantity, carbon black is preferable. These conductive fine particles are suitably used in a range of 0.5 parts by mass to 50 parts by mass, particularly in a range of 1 part by mass to 30 parts by mass based on 100 parts by mass of the substrate.

(Ion Conductive Material)

An example of the ion conductive material includes the following.

1) An inorganic ionic conductive material such as sodium perchlorate, lithium perchlorate, calcium perchlorate, lithium chloride, and the like.

2) An organic ionic conductive material such as degenerative aliphatic dimethylammoniumethosulfate and stearylammoniumacetate.

In the present invention, a method of dispersing the resistance regulator into the material forming the elastic layer 2 is not particularly limited, and the dispersion can be performed also by using a publicly known device such as a roll, a Banbury mixer, a pressure kneader, and the like.

The method of dispersing the resistance adjusting agent and the urethane resin particle into the coating material which forms the surface layer 3 is not particularly limited. In a resin solution in which the resin material is dissolved in an appropriate organic solvent, the resistance adjusting agent, the urethane resin particle, and the like are added, and can be dispersed by using a publicly known device such as a sand grinder, a sand mill, a ball mill, and the like.

(Electric Resistance of Developing Roller)

An electric resistance of the developing roller of the present invention is preferably $1\times10^5\Omega$ or more and $1\times10^7\Omega$ or less. That is, when used in the process of applying a bias to the developing roller, in case the electric resistance value is below $1\times10^5\Omega$, a blade bias leak is liable to occur, and when the electric resistance value exceeds $1\times10^7\Omega$, a developing negative ghost is liable to occur.

(Electric Resistance Measuring Method of Developing Roller)

Figure 7:
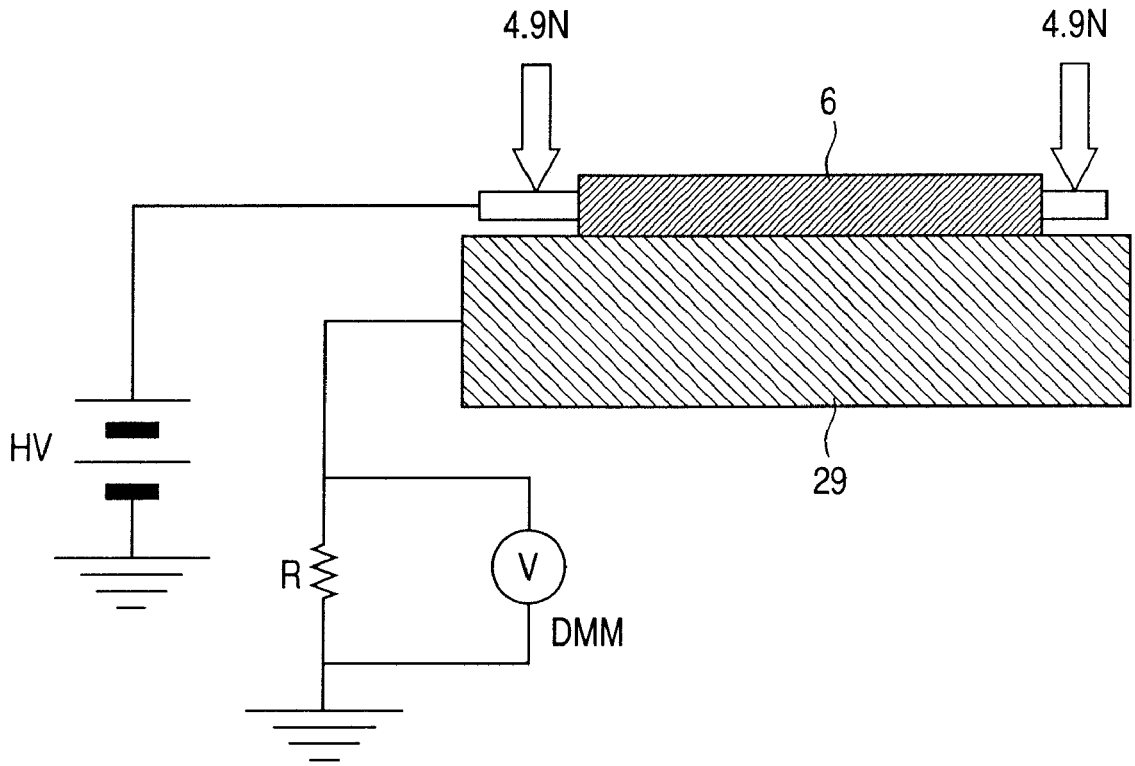
FIG. 7 is an explanatory drawing of a measuring method of an electric resistance of the developing roller according to the present invention.

As an electric resistance measuring device, a device such as illustrated in FIG. 7 is used. The developing roller 6 is abutted on a metal drum 29 having a diameter of 50 mm by applying a load of 4.9 N on both ends of the mandrel of the developing roller, respectively, and by driving the metal drum 29 by an unillustrated drive means at a surface speed of 50 mm/sec, the developing roller 6 is driven and rotated.

From a high voltage source HV, a voltage of +50V is applied to the mandrel of the developing roller. The potential difference between both ends of a resistor R having a known electric resistance disposed between the metal roller 29 and a ground is measured by using a digital multi-meter DMM (Product name: 189TRUE RMS MULTIMETER; made by Fluke Corp.)

The electric resistance uses the one two digits lower in electric resistance for the electric resistance of the developing roller.

From the potential difference and the electric resistance of the resistor, the current let flow to the metal roller through the developing roller is determined by calculation. By calculating from that current and the applied voltage of 50V, the electric resistance of the developing roller is determined.

Here, the measurement by the digital multi-meter is performed such that a sampling is performed for three seconds after two seconds from the voltage application, and the value calculated from the average value is taken as a resistance value of the developing roller.

(Developing Apparatus)

Further, the developing apparatus 10 according to the present invention is a developing apparatus including the developing roller and used for the electrophotographic apparatus.

The developing apparatus includes monocomponent dry developer, a developing roller carrying the developer on the surface, and a developing blade for controlling the developer amount on the developing roller.

By using the developing roller according to the present invention as a developing roller, whatever toner is used, both the fog and the resulting stripe from development can be improved at the same time.

Further, since much higher improvement effect of the resulting stripe from development and the fog can be obtained, when the volume average particle diameter of the developer is taken as dt, it is preferable that the following relational formula (13) is satisfied, and it is particularly preferable that the volume average particle diameter dt of the developer is 5.0 μm or more and 6.5 μm or less.

$$1.0 \leqq (d2-d1)/dt \leqq 2.0 \quad (13)$$

Figure 5:
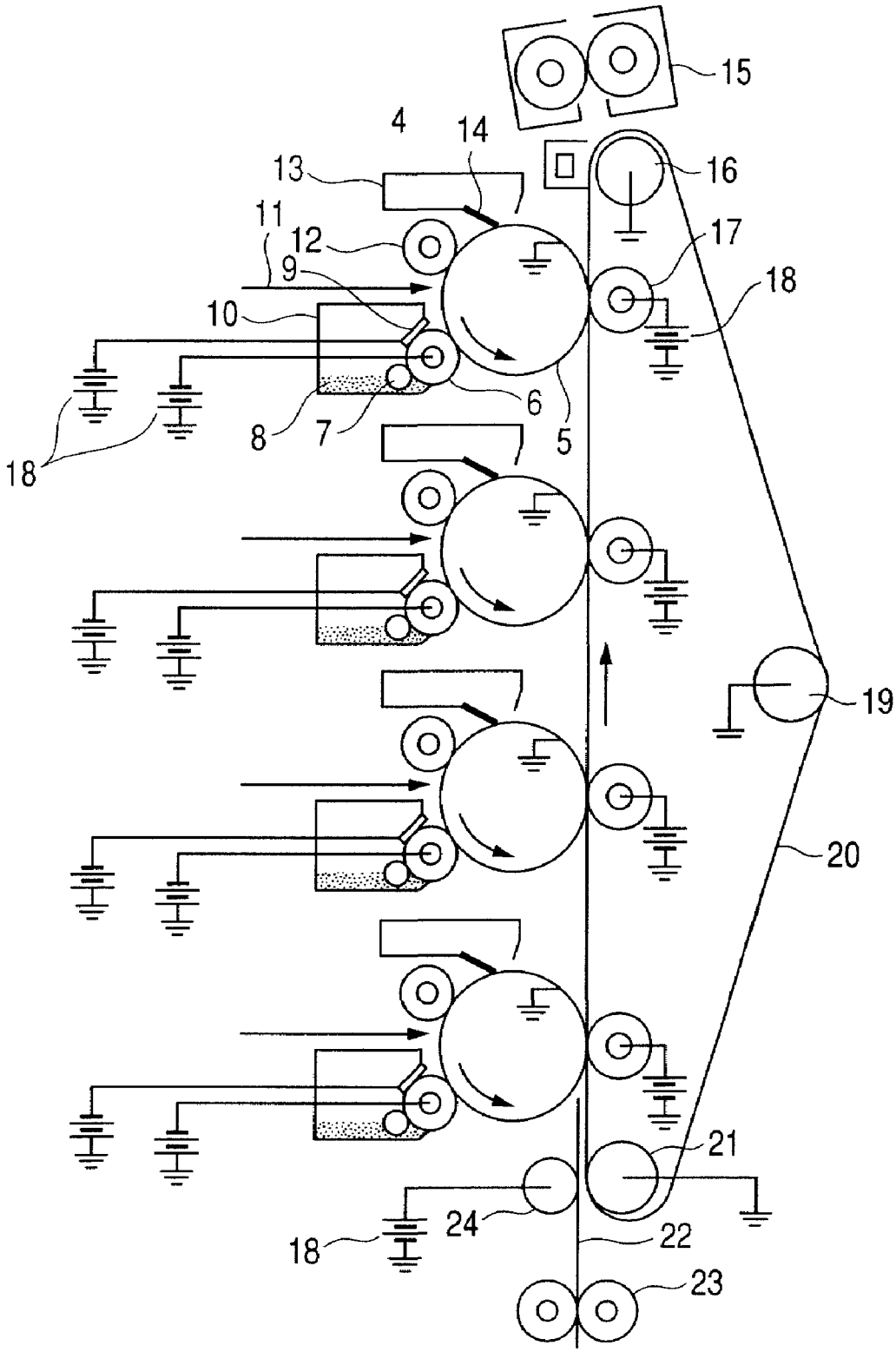
FIG. 5 is a schematic cross-sectional view of an image forming apparatus according to the present invention.

These developing apparatuses, as illustrated in FIG. 5, can also be used as an all-in-one process cartridge 4 integrated with a photosensitive drum, a cleaning blade, a waste toner container, and a charging apparatus.

Here, the volume average particle diameter of the developer can be measured by the precision particle size distribution measurement device (Product name: Multisizer 2; made by Beckman Coulter, Inc.).

The precision particle size distribution measurement device is connected to an interface (made by BIOS CORPORATION) for outputting a number distribution and a volume distribution and a personal computer.

As an electrolyte, 1% NaCl aqueous solution is prepared by using primary sodium chloride. Ad the electrolyte, ISOTON (Product name: R-II, made by Beckman Coulter, Inc.) and the like may be used. First, 0.1 to 5 ml of a surfactant (preferably alkyl benzene sulfonate) as a dispersing agent is added into 100 to 150 ml of the electrolyte. Further, 2 to 20 mg of a measurement sample is added. The electrolyte having suspending the measurement sample is subjected to distributing processing for approximately one to three minutes by ultrasonic dispersion. The electrolyte subjected to distributing processing is used as a measurement sample, and the volume particle size distributions of 16 channels are measured in a range of 1.59 μm to 64.00 μm by the Coulter Multisizer adopting an aperture of 100 μm. A 550% D diameter thus measured is taken as a volume average particle diameter of the developer in the present invention.

The developer (toner) usable in the present invention, for example, can be manufactured by the following method, but it is not limited to the following method.

1) A method of directly forming a toner particle by using a suspension polymerization method disclosed in Japanese Patent Publication No. S36-010231, Japanese Patent Application Laid-Open Nos. S59-053856 and S59-061842, Japanese Patent Application Laid-Open No. 2006-106198, and the like.
2) An emulsion polymerization method as represented by a soap-free polymerization method for forming a toner particle by being directly polymerized under the presence of a water soluble polymerization initiator soluble to monomer.
3) An interfacial polymerization method such as a microcapsule manufacturing process.
4) An in-site polymerization method.
5) A coacervation method.
6) An association polymerization method of aggregating at least one or more kinds of fine particles so as to obtain the toner particle of a desired particle diameter disclosed in Japanese Patent Application Laid-Open Nos. S62-106473 and S63-186253, and the like.
7) A dispersion polymerization process characterized in monodispersity.
8) A method by emulsion dispersion for obtaining a toner particle in the water after dissolving the resins necessary for nonaqueous organic solvent.
9) A fracturing method including the following processes.

A process of kneading and uniformly dispersing the toner component by using a pressurizing kneader, an extruder or a media dispersion instrument, and the like.

A process thereafter is to cool the kneaded matter and let it collide against a target matter mechanically or under a jet stream so as to be pulverized into a desired toner particle diameter.

After that, a classifying process of making a particle size distribution of the toner further sharper.

10) A method of subjecting the toner particle obtained by the crushing method to a sphere forming process in the solvent by heating and the like, thereby to obtain the toner particle.

Above all, the manufacturing of the toner particle by the suspension polymerization method, the association polymerization method, the emulsification polymerization method is preferable, and the suspension polymerization method which can easily obtain the toner particle of a small particle diameter is more preferable.

The shape of the toner particle is preferably close to a spherical shape, and specifically, with respect to shape coefficient of the toner particle, SF-1 is preferably 100 to 150 and is more preferably 100 to 140, and is further preferably in the range of 100 to 130, whereas SF-2 is preferably 100 to 140, and is more preferably 100 to 130, and is further preferably in the range of 100 to 120. The measurement method of the shape coefficient SF-1 and SF-2 of the toner will be described below.

(Measurement Method of Shape Coefficient SF-1 and SF-2 of Toner)

By using an electron microscope (Product Name: FE-SEM (S-800); made by Hitachi Seisakusho), 100 pieces of toner images are sampled at random by a magnifying power of 3000 times. The image information thereof is introduced to an image analyzer (Product name: Luzex 3; made by Nireco Corporation) through an interface, and an analysis is performed, and the values calculated and obtained by the following formulas are defined as shape coefficient.

$$SF\text{-}1=\{(MXLNG)2/\mathrm{AREA}\}\times(\pi/4)\times 100$$

$$SF\text{-}2=\{(PERI)2/\mathrm{AREA}\}\times(1/4\pi)\times 100$$

(MXLNG: Absolute Maximum Length, AREA: Toner Projection

Area, PERI: Peripheral Length)

Further, when the developing roller of the present invention is used even in the developing apparatus having a mechanism for applying a bias on the developing blade, the resulting stripe from development and the fog can be improved, and therefore, this is preferable.

FIG. 5 is a cross-sectional view showing a schematic configuration of an image forming apparatus using the developing roller and a process cartridge provided with the developing roller. The image forming apparatus of FIG. 5 is mounted detachably with a process cartridge. 4.

The process cartridge 4 includes a developing roller 6, a developer coating member 7, a developer 8, a developing apparatus 10, a photosensitive drum 5, a cleaning blade 14, a waste toner container 13, and a charging apparatus 12. The developing apparatus 10 is made of a developing blade 9 having a mechanism capable of applying a blade bias. The photosensitive drum 5 rotates in an arrow direction, and is uniformly charged by a charging member 12 for subjecting the photosensitive drum 5 to a charging process, and is formed with an electrostatic latent image on its surface by a laser light 11 serving as an exposure means for writing the electrostatic latent image on the photosensitive drum 5. The electrostatic latent image is developed by being supplied with the toner by the developing apparatus 10 which is contact-disposed on the photosensitive drum 5, thereby to be visualized as a toner image.

The development is performed by a so-called reverse developing to form a toner image on an exposing portion. A paper 22 serving as a recording medium is fed to a transfer conveying belt 20 by a sheet feeding roller 23 and an adsorption roller 24. Reference numeral 18 denotes a bias power source for applying a bias on the adsorption roller 24. The transfer conveying belt 20 is spanned across a driving roller 16, a tension roller and a following roller 21, and is rotated by the driving roller 16. The visualized toner image on the photosensitive drum 5 is transferred on the paper 22 conveyed by the transfer conveying belt 20 by a transfer roller 17. The paper 22 transferred with the toner image is subjected to a fixing process by a fixing device 15, and is discharged outside the apparatus, and a printing operation is completed.

On the other hand, a residual toner not having been transferred and remaining on the photosensitive drum 5 is scraped by a cleaning blade 14 serving as a cleaning member for cleaning the photosensitive drum surface, and is stored into a waste toner container 13, whereas the cleaned photosensitive drum 5 repeatedly performs the above-described operation.

The developing apparatus 10 includes a developer container storing a non-magnetic toner 8 as monocomponent developer, and a developing roller 6 as a developer carrying body positioned at an opening portion extending in the longitudinal direction in the developing container and disposed opposite to the photosensitive drum 5, and develops an electrostatic latent image on the photosensitive drum 5 so as to be visualized.

A developing process in the developing apparatus 10 will be described below. By a toner coating member 7 rotatably supported, a toner is coated on the developing roller 6. The toner coated on the developing roller 6 is rubbed with the developing blade 9 by the rotation of the developing roller 6.

Here, by a bias applied on the developing blade 9, the toner on the developing roller is uniformly coated on the developing roller. The developing roller 6 contacts the photosensitive drum 5, while rotating together, and develops the electrostatic latent image formed on the photosensitive drum 5 by the toner coated on the developing roller 6, thereby to form an image. Here, the polarity of the bias applied on the developing blade 9 is the same polarity as the charged polarity of the toner, and as its voltage, a voltage from several tens to several hundreds voltage higher than the developing bias is commonly used. When a bias is applied to the developing blade in this manner, the developing blade is preferable to be conductive, and a metal such as phosphor bronze and stainless is more preferable.

As a structure of the toner coating member 7, a skeleton type foaming sponge structure and a fur brush structure transplanted with fibers such as rayon, polyamide and the like on the mandrel are preferable in view of the feeding of the toner 8 to the developing roller 6 and the scraping off of the undeveloped toner. For example, an elastic roller provided with polyurethane foam on the mandrel can be used.

As an abutting width of this toner coating member 7 on the developing roller, 1 mm or more and 8 mm or less is preferable. Further, allowing the developing roller 6 to have a relative speed for the abutting portion is preferable.

EMBODIMENTS

Hereinafter, while the present invention will be described by using embodiments and comparative examples in details, but the present embodiment does not limit the present invention.

The kinds of the resin particles used in each embodiment and each comparative example are as follows. It is to be noted that the volume average particle diameter of each resin particle is a measurement value by a precision particle size distribution measurement device (Product name: Multisizer 2; made by Beckman Coulter, Inc.).

(Resin Particle A)

A urethane resin particle (Product name: Art Pearl C800 transparent; made by Negami Chemical Industrial Co. Ltd., the volume average particle diameter 7.3 μm).

(Resin Particle B)

A urethane resin particle (Product name: Art Pearl C600 transparent; made by Negami Chemical Industrial Co. Ltd., the volume average particle diameter 10.3 μm).

(Resin Particle C)

A urethane resin particle (Product name: Art Pearl C400 transparent; made by Negami Chemical Industrial Co. Ltd., the volume average particle diameter 14.0 μm).

(Resin Particle D)

A urethane resin particle (Product name: Art Pearl C300 transparent; made by Negami Chemical Industrial Co. Ltd., the volume average particle diameter 21.5 μm).

(Resin Particle E)

A urethane resin particle (Product name: Art Pearl C200 transparent; made by Negami Chemical Industrial Co. Ltd., the volume average particle diameter 30.5 μm).

(Resin Particle Aa)

A resin particle A removing a coarse powder by using a classifier (Product name: Turbo Flex 100 ATP; made by Hosokawa Micron Corporation) and adjusted to volume average particle diameter 6.0 μm, 25% D diameter 5.0 μm, and 75% D diameter 6.7 μm.

(Resin Particle Ab)

A resin particle A removing a fine powder and a coarse powder by using the classifier above and adjusted to volume average particle diameter 6.8 μm, 25% D diameter 5.3 μm, and 75% D diameter 7.3 μm.

(Resin Particle Ac)

A resin particle A removing a coarse powder by using the classifier above and adjusted to volume average particle diameter 4.7 μm, 25% D diameter 4.0 μm, and 75% D diameter 5.2 μm.

(Resin Particle Ad)

A resin particle A removing a fine powder and a coarse powder by using the classifier above and adjusted to volume average particle diameter 7.5 μm, 25% D diameter 6.5 μm, and 75% D diameter 7.8 μm.

(Resin Particle Ae)

A resin particle A removing a fine powder and a coarse powder by using the classifier above and adjusted to volume average particle diameter 7.0 μm, 25% D diameter 6.2 μm, and 75% D diameter 7.2 μm.

(Resin Particle Ba)

A resin particle B removing a coarse powder by using the classifier above and adjusted to volume average particle diameter 9.3 μm, 25% D diameter 7.6 μm, and 75% D diameter 10.7 μm.

(Resin Particle Bb)

A resin particle B removing a fine powder and a coarse powder by using the classifier above and adjusted to volume average particle diameter 10.0 μm, 25% D diameter 8.5 μm, and 75% D diameter 10.7 μm.

(Resin Particle Ca)

A resin particle C removing a coarse powder by using the classifier above and adjusted to volume average particle diameter 15.3 μm, 25% D diameter 12.3 μm, and 75% D diameter 17.0 μm.

(Resin Particle Cb)

A resin particle C removing a fine powder and a coarse powder by using the classifier above and adjusted to volume average particle diameter 12.3 μm, 25% D diameter 9.2 μm, and 75% D diameter 14.7 μm.

(Resin Particle Cc)

A resin particle C removing a fine powder and a coarse powder by using the classifier above and adjusted to volume average particle diameter 14.8 μm, 25% D diameter 13.5 μm, and 75% D diameter 15.1 μm.

(Resin Particle Ce)

A resin particle C removing a fine powder and a coarse powder by using the classifier above and adjusted to volume average particle diameter 12.0 μm, 25% D diameter 10.5 μm, and 75% D diameter 12.9 μm.

(Resin Particle Cf)

A resin particle C removing a fine powder and a coarse powder by using the classifier above and adjusted to volume average particle diameter 17.3 μm, 25% D diameter 15.3 μm, and 75% D diameter 18.4 μm.

(Resin Particle Ea)

A resin particle E removing a coarse powder by using the classifier above and adjusted to volume average particle diameter 26.5 μm, 25% D diameter 19.6 μm, and 75% D diameter 32.0 μm.

(Resin Particle Da)

A resin particle D removing a coarse powder by using the classifier above and adjusted to volume average particle diameter 19.3 μm, 25% D diameter 15.5 μm, and 75% D diameter 23.3 μm.

(Resin Particle Db)

A resin particle D removing a fine powder by using the classifier above and adjusted to volume average particle diameter 24.2 μm, 25% D diameter 20.2 μm, and 75% D diameter 26.9 μm.

(Resin Particle Dc)

A resin particle D removing a fine powder and a coarse powder by using the classifier above and adjusted to volume average particle diameter 19.5 μm, 25% D diameter 17.3 μm, and 75% D diameter 20.5 μm.

(Resin Particle F)

An acryl resin particle (Product name: Chemisnow MX1500H; made by Soken Chemical and Engineering Co. Ltd., the volume average particle diameter 15.0 μm).

EXAMPLE 1

Preparation of Developing Roller (Formation of Elastic Layer)

The surface of the cored bar made of SUS of 8 mm in diameter nickel-plated, and further coated and baked with PRIMER (Product name: DY35-051; made by Dow Corning Toray Silicon Co Ltd.) was prepared as a mandrel 1.

The mandrel 1 was disposed inside a cylindrical mold of 16 mm in inner diameter so as to be coaxial with the cylindrical mold. Next, an addition silicone rubber composition of the following composition was injected into the mold. Subsequently, the mold was heated, and the addition silicone rubber composition was vulcanized and hardened for 15 minutes at the temperature 150° C. After removing the hardened silicone rubber from the mold, the silicone rubber was further heated for two hours at the temperature 200° C., thereby completing a hardening reaction. The elastic layer 2 made of silicone rubber of 4 mm in thickness was disposed on the outer periphery of the mandrel 1.

(Composition of Addition Silicone Rubber Composition)

Liquid silicone rubber (Product name: SE6724A/B; made by Dow Corning Toray Silicon Co Ltd.): 100 parts by mass, Carbon black (Product name: TOKABLACK #7360SB; made by Tokai Carbon Co. Ltd.): 35 parts by mass, Silica powder as a heat resistance imparting agent: 0.2 parts by mass, Platinum catalyst: 0.1 parts by mass.

(Synthesis of Polyol)

The following materials were mixed in a stepwise fashion in MEK solvent, and were reacted for seven hours under the nitrogen atmosphere at 80° C., and polyetherpolyol whose hydroxyl group value is 20 was fabricated.

Polytetramethyleneglycol (Product name: PTG1000SN; made by Hodogaya Chemical Co. Ltd.): 100 parts by mass, Isocyanate compound (Product name: MILLIONATE MT; made by Nippon Polyurethane Industry co. Ltd.): 20 parts by mass.

(Synthesis of Isocyanate)

Under nitrogen atmosphere, the following materials were heat-reacted for two hours at the temperature 90° C.

Polypropyleneglycol of a number average molecular weight of 500:100 parts by mass, Crude MDI: 57 parts by mass.

Subsequently, butyl cellosolve was added so as to become a solid content of 70%, and an isocyanate compound of 5.0% of NCO % per solid content was obtained. After that, under the condition of the reaction product temperature 50° C., 22 parts by mass of MEK oxime was dropwised, thereby block polyisocyanate A was obtained.

(Preparation of Surface Layer Coating Material)

Polyol and blockpolyisocyanate A prepared in the above-described manner were mixed so as to become 1.4 in NCO/OH group ratio. The mixed material was mixed with 20 parts by mass of carbon black (Product name: MA100; made by Mitsubishi Chemical Corporation, Ph=3.5) based on 100 parts by mass of a binder resin solid content. Further, MEK was added so that a total solid content ratio becomes 35 mass %, and by using glass beads of 1.5 mm in diameter and by using a sand mill, MEK was dispersed for four hours, thereby to prepare a dispersion liquid 1.

On the other hand, in the same quantity of MEK as the binder resin component solid content in the dispersion liquid 1, the following resin particles were added, and were subjected to ultrasonic dispersion, so that the spherical resin particle dispersion liquid was obtained.

Resin particle A: 24 parts by mass

Resin particle C: 6 parts by mass

The obtained resin particle dispersion liquid was added to the dispersion liquid 1, and was dispersed by using the sand mill for further 30 minutes, so that the surface layer coating material was obtained.

In the present invention, the surface layer binder resin additive amount of the resin particle added in the surface layer and the result are shown in Table 1.

(Formation of Surface Layer on Elastic Layer)

The surface layer coating materials thus obtained as described above were dip-coated on the elastic layers, respectively, by using a dip-coating device of an overflow type as illustrated in FIG. 6, and after that, were dried, and were heat-treated for two hours at the temperature 150° C. so as to provide the resin layer of 10 μm on the elastic layer surface, thereby obtaining the developing roller of the example 1.

The obtained developing roller was kept still standing for 24 hours and more in the environment of 23° C./55% Rh, and the following various measurements were conducted.

(Measurement of Volume Particle Size Distribution of Resin Particle in Developing Roller Surface Layer)

The volume particle size distribution of the resin particle in the developing roller surface layer obtained as described above was measured by the above-described method. The measurement result is shown in Table 2-1.

(Measurement of Thickness of Developing Roller Surface Layer)

From a total of three points of the center portion of the developing roller, and the center portion sides inside 30 mm from both end portions of the roller, the surface layer of the developing roller was carved out together with the elastic layer in the shape of a fish sausage by using a sharp razor blade, so that the surface layer thickness measurement samples (1) to (3) were obtained. In each of the obtained samples (1) to (3), by changing the location of the measurement, the surface thickness was measured at five points, and the average value of the measurement result of a total 15 points was taken as a surface layer thickness of the developing roller. Here, as means for measuring the surface layer thickness, a video microscope (made by Keyence Corporation, magnifying power 2000 times) was used. The measurement result is shown in Table 1.

(Measurement of Distortion Degree Rsk of Roughness Curve in Developing Roller Surface Roughness)

The distortion degree Rsk of the roughness curve in the surface roughness of the developing roller thus obtained was measured by the above-described method. The measurement result is shown in Table 2-1.

(Measurement of Electric Resistance of Developing Roller)

The electric resistance of the developing roller obtained as described above was measured. The result is shown in Table 2-1.

(Measurement of Micro Rubber Hardness of Developing Roller Surface)

By using a micro rubber hardness meter MD-1 type A made by KOBUNSHI KEIKI CO. LTD. the surface hardness of the developing roller was measured. The measurement points were the same 12 points as the measurement points of the distortion degree Rsk of the roughness curve in the developing roller surface roughness, and its average value was taken as the surface hardness of the developing roller. The measurement result is shown in Table 2-1.

(Measurement of Rough Particle Ingredient Amount of Resin Particle)

The resin particles were mixed so as to obtain the same mixed ratio as the resin particles added in the surface layer coating material, and the volume particle size distribution of the mixed particles were measured by using the precision particle size distribution measurement device (Product name: Multisizer 2; made by Beckman Coulter, Inc.). Specifically, the precision particle size distribution measurement device was connected to an interface (made by BIOS CORPORATION) for outputting a number distribution and a volume distribution and a personal computer. As an electrolyte, by using primary sodium chloride, 1% NaCl aqueous solution was prepared. As a dispersing agent, 0.1 ml of an interfacial active agent was added into 100 ml of the electrolyte, and further, approximately 5 mg of a measurement sample was added. The electrolyte having suspending the measurement sample was subjected to distributing processing for approximately one minute by ultrasonic dispersion. With the electrolyte subjected to ultrasonic processing taken as a measurement sample, the volume particle size distributions of 128 channels was measured in a range of 1.59 μm to 64.00 μm by using the precision particle size distribution measurement device adopting an aperture of 100 μm. From the measurement result, the volume fraction B (%) of the particle having the particle diameter 1.2 times more than the surface layer film thickness was determined. Further, when a blending quantity of the resin particle relative to the resin 100 parts by mass of the surface layer was taken as A (parts by mass), the value derived from the following relative formula was taken as a rough particle ingredient amount of the resin particle. The measurement result is shown in Table 1.

(rough particle ingredient amount of resin particle) $=A\times B/100$ (Image Outputting Test)

With respect to a process cartridge (Product name: LBP5500; made by Canon Corporation) for printer, a blade made of SUS of 80 μm in thickness was used for the developing blade, and modification was made such that a blade bias can be applied on this developing blade.

This process cartridge was filled with a magenta toner of a volume particle size average particle 5.5 μm, 114 in the shape coefficient SF-1, and 108 in shape coefficient SF-2 manufactured by the polymerization method as disclosed in the first embodiment of Japanese Patent Application Laid-Open No. 2006-106198. Further, this process cartridge was fitted with the developing roller prepared as described above, thereby preparing three image outputting test cartridges.

A printer (Product name: LBP 5500; made by Cannon Corporation) was modified so as to be able to apply a blade bias on the developing blade. This printer was installed with the image outputting test cartridges, and the image outputting test was conducted. Here, this developing bias was applied with a blade bias of −200V, and under each environment of the temperature 23° C./humidity 55% Rh (N/N environment), the temperature 15° C./humidity 10% Rh (L/L environment), and the temperature 30° C./humidity 80% Rh (H/H environment), an image of the printing rate of 1% was continuously output. The presence or absence of the resulting stripe from development was confirmed every 1000 sheets output, and finally, an image output of 20000 (20K) sheets was performed, and the resulting stripe from development and the fog ware estimated by the following method.

The confirmation of the presence or absence of the occurrence of the resulting stripe from development was determined by outputting a solid image and a halftone image and visually checking these images. The developing roller in which no resulting stripe from development has occurred even after 20000 (20K) sheets of the image was output was given the best [A] in an estimation rank.

On the other hand, prior to outputting 20000 (20K) sheets of the image, with respect to those having caused the resulting stripe from development even if it is minor, the number of sheets bearing the resulting stripe from development was recorded.

With respect to the fog, a solid white image was output, and a reflection density of a blank space of the solid white image was measured by using a reflex type concentration meter TC-6DS/A made by Tokyo Denshoku Co. Ltd., and an average value of 10 points measured on the image was taken as Ds. The difference (Dr−Ds) between the reflection density (its average value was taken as Dr) of the sheet before outputting the solid white image and Ds was determined, and this was taken as a fog amount. In general, the image exceeding 1.0 in fog density is taken as a defective image, and is recognized as adversely affecting the image.

In the present example, under any of the circumstances, the resulting stripe from development and the fog were excellent. The result is shown in Table 3.

EXAMPLE 2 TO EXAMPLE 25 AND COMPARATIVE EXAMPLE 1 TO COMPARATIVE EXAMPLE 10

Except that each of an adding resin particle, an additive amount of the resin particle, and the surface layer thickness was changed as shown in Table 1, the developing roller was prepared similarly to the first example. Further, similarly to the first example, various measurements and estimations were performed. The result is shown in Table 2-1 and Table 3.

TABLE 1

| | First Spherical Resin Particle | | | Second Spherical Resin Particle | | | Particle | | |
|---|---|---|---|---|---|---|---|---|---|
| | Kinds | Particle Diameter (μm) | Additive Amount (Part by Mass) | Kinds | Particle Diameter (μm) | Additive Amount (Part by Mass) | Additive Amount (Part by Mass) | Thickness of Surface Layer (μm) | Rough Particle Ingredients (*1) |
| Examples | | | | | | | | | |
| 1 | A | 7.3 | 24 | C | 14.0 | 6 | 30 | 10 | 5.8 |
| 2 | Ad | 7.5 | 26 | Cc | 14.8 | 4 | 30 | 10 | 3.7 |
| 3 | Ae | 7.0 | 25 | Ce | 12.0 | 5 | 30 | 10 | 4.0 |
| 4 | Bb | 10.0 | 25 | Cc | 14.8 | 5 | 30 | 12 | 5.8 |
| 5 | Ae | 7.0 | 25 | Cf | 17.3 | 5 | 30 | 10 | 5.0 |
| 6 | Bb | 10.0 | 25 | Dc | 19.5 | 5 | 30 | 12 | 6.0 |
| 7 | A | 7.3 | 22 | C | 14.0 | 8 | 30 | 10 | 7.0 |
| 8 | Ba | 9.3 | 14 | Da | 19.3 | 6 | 20 | 12 | 4.9 |
| 9 | Aa | 6.0 | 25 | C | 14.0 | 6 | 31 | 10 | 3.9 |
| 10 | A | 7.3 | 24 | C | 14.0 | 6 | 30 | 9 | 7.0 |
| 11 | B | 10.3 | 15 | D | 21.5 | 4 | 19 | 12 | 5.0 |
| 12 | Ab | 6.8 | 24 | Cb | 12.3 | 6 | 30 | 10 | 3.1 |
| 13 | Aa | 6.0 | 25 | B | 10.3 | 6 | 31 | 9 | 3.0 |
| 14 | D | 21.5 | 12 | Ea | 26.5 | 3 | 15 | 20 | 5.5 |
| 15 | Ab | 6.8 | 24 | B | 10.3 | 6 | 30 | 9 | 3.5 |
| 16 | Ca | 15.3 | 12 | Ea | 26.5 | 3 | 15 | 12 | 8.9 |
| 17 | Ca | 15.3 | 12 | Ea | 26.5 | 3 | 15 | 17 | 3.0 |
| 18 | A | 7.3 | 26 | C | 14.0 | 4 | 30 | 10 | 4.7 |
| 19 | A | 7.3 | 35 | C | 14.0 | 4 | 39 | 8 | 9.0 |
| 20 | Ab | 6.8 | 24 | Cc | 14.8 | 5 | 29 | 10 | 6.5 |
| 21 | A | 7.3 | 35 | C | 14.0 | 4 | 39 | 9 | 6.0 |
| 22 | Cb | 12.3 | 12 | Da | 19.3 | 3 | 15 | 12 | 3.8 |
| 23 | A | 7.3 | 28 | C | 14.0 | 2 | 30 | 10 | 3.5 |
| 24 | Cb | 12.3 | 12 | Da | 19.3 | 3 | 15 | 15 | 3.0 |
| 25 | A | 7.3 | 15 | C | 14.0 | 10 | 25 | 10 | 8.5 |
| Comparative Examples | | | | | | | | | |
| 1 | A | 7.3 | 30 | — | — | — | 30 | 10 | 2.3 |
| 2 | B | 10.3 | 30 | — | — | — | 30 | 15 | 0.6 |
| 3 | Ac | 4.7 | 25 | B | 10.3 | 6 | 31 | 10 | 2.4 |
| 4 | Ac | 4.7 | 25 | C | 14.0 | 6 | 31 | 10 | 2.9 |
| 5 | Aa | 6.0 | 25 | Ba | 9.3 | 6 | 31 | 10 | 0.4 |
| 6 | D | 21.5 | 12 | E | 30.5 | 3 | 15 | 17 | 9.7 |
| 7 | Db | 24.2 | 12 | Ea | 26.5 | 3 | 15 | 17 | 11.1 |
| 8 | A | 7.3 | 29 | C | 14.0 | 1 | 30 | 10 | 2.9 |
| 9 | Ad | 7.5 | 23 | Cc | 14.8 | 6 | 29 | 10 | 8.5 |
| 10 | F | 15.0 | 12 | D | 21.2 | 3 | 15 | 17 | 2.3 |

(*1) Value measured by using Coulter Multisizer II

TABLE 2-1

| | d1 (*1) | | d2 (*1) | | | | | d3 (*1) | | | | | Developing Roller |
|---|---|---|---|---|---|---|---|---|---|---|---|---|---|
| Examples | Particle Diameter (μm) | a (Vol. %) | Particle Diameter (μm) | b (Vol. %) | a/b | d2 − d1 | (d2 − d1)/dt | Particle Diameter (μm) | c (Vol. %) | c/b | Rsk | MD-1 Hardness | Electric Resistance (Ω) |
| 1 | 7.6 | 12.8 | 15.1 | 4.0 | 3.2 | 7.5 | 1.4 | 13.5 | 3.7 | 0.9 | 0.55 | 35 | $1 \times 10^6$ |
| 2 | 7.6 | 26.0 | 15.1 | 6.0 | 4.3 | 7.5 | 1.4 | 12.0 | 0.8 | 0.1 | 0.32 | 35 | $1 \times 10^6$ |
| 3 | 6.7 | 31.6 | 12.0 | 7.4 | 4.3 | 5.3 | 1.0 | 9.5 | 3.0 | 0.4 | 0.35 | 35 | $1 \times 10^6$ |
| 4 | 9.5 | 26.3 | 15.1 | 7.5 | 3.5 | 5.6 | 1.0 | 13.5 | 7.5 | 1.0 | 0.55 | 36 | $1 \times 10^6$ |
| 5 | 6.7 | 31.6 | 17.0 | 6.9 | 4.6 | 10.3 | 1.9 | 12.0 | 0.3 | 0.0 | 0.47 | 35 | $1 \times 10^6$ |
| 6 | 9.5 | 27.5 | 19.1 | 6.5 | 4.2 | 9.6 | 1.7 | 15.1 | 1.7 | 0.3 | 0.60 | 36 | $1 \times 10^6$ |
| 7 | 7.6 | 12.0 | 15.1 | 4.9 | 2.4 | 7.5 | 1.4 | 13.5 | 4.4 | 0.9 | 0.65 | 35 | $1 \times 10^6$ |
| 8 | 10.7 | 16.7 | 21.4 | 5.5 | 3.0 | 10.7 | 1.9 | 17.0 | 2.9 | 0.5 | 0.38 | 36 | $1 \times 10^6$ |
| 9 | 6.0 | 19.2 | 15.1 | 2.8 | 6.9 | 9.1 | 1.7 | 13.5 | 1.9 | 0.7 | 0.28 | 35 | $1 \times 10^6$ |
| 10 | 7.6 | 12.8 | 15.1 | 4.0 | 3.2 | 7.5 | 1.4 | 13.5 | 3.7 | 0.9 | 0.55 | 33 | $1 \times 10^6$ |
| 11 | 12.0 | 14.1 | 24.0 | 3.5 | 4.0 | 12.0 | 2.2 | 21.4 | 3.4 | 1.0 | 0.47 | 36 | $1 \times 10^6$ |
| 12 | 7.6 | 16.3 | 15.1 | 3.5 | 4.7 | 7.5 | 1.4 | 13.5 | 3.2 | 0.9 | 0.24 | 35 | $1 \times 10^6$ |
| 13 | 6.0 | 19.4 | 10.7 | 3.4 | 5.7 | 4.7 | 0.9 | 10.7 | 3.3 | 1.0 | 0.21 | 33 | $1 \times 10^6$ |
| 14 | 21.4 | 11.3 | 27.0 | 7.3 | 1.5 | 5.6 | 1.0 | 24.0 | 7.5 | 1.0 | 0.50 | 42 | $1 \times 10^6$ |
| 15 | 6.7 | 16.5 | 10.7 | 4.0 | 4.1 | 4.0 | 0.7 | 10.7 | 4.4 | 1.1 | 0.20 | 33 | $1 \times 10^6$ |
| 16 | 15.1 | 15.4 | 27.0 | 2.9 | 5.3 | 11.9 | 2.2 | 24.0 | 2.9 | 1.0 | 0.70 | 36 | $1 \times 10^6$ |
| 17 | 15.1 | 15.4 | 27.0 | 2.9 | 5.3 | 11.9 | 2.2 | 24.0 | 2.9 | 1.0 | 0.25 | 40 | $1 \times 10^6$ |

TABLE 2-1-continued

| Examples | d1 (*1) Particle Diameter (μm) | d1 (*1) a (Vol. %) | d2 (*1) Particle Diameter (μm) | d2 (*1) b (Vol. %) | a/b | d2 − d1 | (d2 − d1)/dt | d3 (*1) Particle Diameter (μm) | d3 (*1) c (Vol. %) | c/b | Rsk | MD-1 Hardness | Developing Roller Electric Resistance (Ω) |
|---|---|---|---|---|---|---|---|---|---|---|---|---|---|
| 18 | 7.6 | 13.6 | 15.1 | 3.2 | 4.3 | 7.5 | 1.4 | 13.5 | 2.9 | 0.9 | 0.35 | 35 | $1 \times 10^6$ |
| 19 | 7.6 | 13.6 | 15.1 | 3.2 | 4.3 | 7.5 | 1.4 | 13.5 | 3.2 | 1.0 | 0.70 | 31 | $1 \times 10^6$ |
| 20 | 7.6 | 16.0 | 15.1 | 7.9 | 2.0 | 7.5 | 1.4 | 12.0 | 1.5 | 0.2 | 0.68 | 35 | $1 \times 10^6$ |
| 21 | 7.6 | 14.0 | 15.1 | 2.8 | 5.0 | 7.5 | 1.4 | 13.5 | 2.6 | 0.9 | 0.60 | 33 | $1 \times 10^6$ |
| 22 | 12.0 | 14.9 | 21.4 | 5.0 | 3.0 | 9.4 | 1.7 | 17.0 | 4.9 | 1.0 | 0.33 | 36 | $1 \times 10^6$ |
| 23 | 7.6 | 14.4 | 15.1 | 2.3 | 6.3 | 7.5 | 1.4 | 13.5 | 2.2 | 1.0 | 0.28 | 35 | $1 \times 10^6$ |
| 24 | 12.0 | 14.9 | 21.4 | 5.0 | 3.0 | 7.4 | 1.7 | 17.0 | 4.9 | 1.0 | 0.15 | 38 | $1 \times 10^6$ |
| 25 | 7.6 | 11.3 | 15.1 | 7.6 | 1.5 | 7.5 | 1.4 | 13.5 | 5.8 | 0.8 | 0.68 | 35 | $1 \times 10^6$ |

(*1) Value determined by volume particle size distribution of urethane spherical particle in developing roller surface layer

TABLE 2-2

| Comparative Example | d1 (*1) Particle Diameter (μm) | d1 (*1) a (Vol. %) | d2 (*1) Particle Diameter (μm) | d2 (*1) b (Vol. %) | a/b | d2 − d1 | (d2 − d1)/dt | d3 (*1) Particle Diameter (μm) | d3 (*1) c (Vol. %) | c/b | Rsk | MD-1 Hardness | Developing Roller Electric Resistance (Ω) |
|---|---|---|---|---|---|---|---|---|---|---|---|---|---|
| 1 | 7.6 | 16.2 | — | — | — | — | — | — | — | — | 0.09 | 35 | $1 \times 10^6$ |
| 2 | 10.7 | 17.3 | — | — | — | — | — | — | — | — | 0.02 | 38 | $1 \times 10^6$ |
| 3 | 4.8 | 20.1 | 10.7 | 3.3 | 6.1 | 5.9 | 1.1 | 10.7 | 1.8 | 0.5 | 0.12 | 35 | $1 \times 10^6$ |
| 4 | 4.8 | 20.0 | 15.1 | 2.8 | 7.3 | 10.3 | 1.9 | 13.5 | 1.2 | 0.4 | 0.14 | 35 | $1 \times 10^6$ |
| 5 | 6.0 | 19.8 | 10.7 | 4.8 | 4.1 | 4.7 | 0.9 | 10.7 | 5.6 | 1.2 | 0.00 | 35 | $1 \times 10^6$ |
| 6 | 21.4 | 11.0 | 30.3 | 7.8 | 1.4 | 8.9 | 1.6 | 24.0 | 7.0 | 0.9 | 0.73 | 40 | $1 \times 10^6$ |
| 7 | 24.0 | 12.3 | 27.0 | 7.6 | 1.6 | 3.0 | 0.5 | 24.0 | 7.7 | 1.0 | 0.85 | 40 | $1 \times 10^6$ |
| 8 | 7.6 | 14.8 | 15.1 | 1.9 | 7.8 | 7.5 | 1.4 | 13.5 | 2.2 | 1.2 | 0.14 | 35 | $1 \times 10^6$ |
| 9 | 7.6 | 24.6 | 15.1 | 9.1 | 3.0 | 7.5 | 1.4 | 12.0 | 1.0 | 0.1 | 0.72 | 35 | $1 \times 10^6$ |
| 10 | 15.1 | 20.5 | 21.4 | 5.3 | 3.9 | 6.3 | 1.1 | 17.0 | 2.0 | 0.4 | 0.11 | 40 | $1 \times 10^6$ |

(*1) Value determined by volume particle size distribution of urethane spherical particle in developing roller surface layer

TABLE 3

| | Temperature 15° C./ Humidity 10% Rh | | Temperature 23° C./ Humidity 55% Rh | | Temperature 30° C./ Humidity 80% Rh | |
|---|---|---|---|---|---|---|
| | Resulting stripe from development | Fog | Resulting stripe from develop-ment | Fog | Resulting stripe from develop-ment | Fog |
| Examples | | | | | | |
| 1 | A | 0.3 | A | 0.4 | A | 0.4 |
| 2 | A | 0.2 | A | 0.3 | A | 0.3 |
| 3 | A | 0.3 | A | 0.3 | A | 0.3 |
| 4 | A | 0.4 | A | 0.3 | A | 0.4 |
| 5 | A | 0.3 | A | 0.3 | A | 0.3 |
| 6 | A | 0.4 | A | 0.4 | A | 0.4 |
| 7 | A | 0.6 | A | 0.3 | A | 0.4 |
| 8 | A | 0.6 | A | 0.4 | A | 0.4 |
| 9 | 17K sheets | 0.8 | A | 0.4 | A | 0.5 |
| 10 | A | 0.4 | A | 0.3 | A | 0.4 |
| 11 | A | 0.8 | A | 0.4 | A | 0.5 |
| 12 | 17K sheets | 0.2 | A | 0.3 | A | 0.3 |
| 13 | 16K sheets | 0.6 | A | 0.3 | A | 0.5 |
| 14 | A | 0.9 | A | 0.5 | A | 0.6 |
| 15 | A | 0.4 | A | 0.4 | A | 0.5 |
| 16 | A | 0.9 | A | 0.6 | A | 0.6 |
| 17 | 18K sheets | 0.7 | A | 0.5 | A | 0.5 |
| 18 | A | 0.3 | A | 0.3 | A | 0.4 |
| 19 | A | 0.8 | A | 0.6 | A | 0.6 |

TABLE 3-continued

| | Temperature 15° C./ Humidity 10% Rh | | Temperature 23° C./ Humidity 55% Rh | | Temperature 30° C./ Humidity 80% Rh | |
|---|---|---|---|---|---|---|
| | Resulting stripe from development | Fog | Resulting stripe from develop-ment | Fog | Resulting stripe from develop-ment | Fog |
| 20 | A | 0.9 | A | 0.5 | A | 0.6 |
| 21 | A | 0.3 | A | 0.3 | A | 0.3 |
| 22 | A | 0.7 | A | 0.4 | A | 0.4 |
| 23 | 17K sheets | 0.3 | A | 0.4 | A | 0.3 |
| 24 | 15K sheets | 0.6 | A | 0.2 | A | 0.3 |
| 25 | A | 0.8 | A | 0.4 | A | 0.4 |
| Comparative Examples | | | | | | |
| 1 | 10K sheets | 0.2 | A | 0.2 | A | 0.3 |
| 2 | 8K sheets | 0.3 | A | 0.3 | A | 0.4 |
| 3 | 12K sheets | 1.2 | A | 0.6 | A | 0.6 |
| 4 | 12K sheets | 1.2 | A | 0.6 | A | 0.7 |
| 5 | 7K sheets | 0.6 | A | 0.7 | A | 0.6 |
| 6 | A | 1.4 | A | 0.7 | A | 0.6 |
| 7 | 12K sheets | 1.5 | A | 0.6 | A | 0.6 |
| 8 | 11K sheets | 0.2 | A | 0.2 | A | 0.3 |
| 9 | A | 1.2 | A | 0.6 | A | 0.7 |
| 10 | 11K sheets | 1.9 | A | 0.7 | A | 0.7 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-275524, filed Oct. 6, 2006, which is hereby incorporated by reference herein in its entirety.

What is claimed is:

1. A developing roller having an elastic layer on the outer periphery of a mandrel and having a surface layer containing a resin and resin particles on the outer periphery thereof, wherein the surface layer has a convex portion attributable to the resin particles, and has a surface of roughness in which a distortion degree Rsk of a roughness curve is 0.15 or more and 0.70 or less, wherein the resin particles have a peak P1 at a particle diameter d1 in a volume particle size distribution, and wherein "a", "b", "c", d1, d2 and d3 satisfy the following relational formulas:

$$4\ \mu m \leqq d2 - d1 \leqq 12\ \mu m$$

$$6\ \mu m \leqq d1 \leqq 22\ \mu m$$

$$10\ \mu m \leqq d2 \leqq 27\ \mu m$$

$$2.0\ \text{Vol.}\ \% \leqq b \leqq 8.0\ \text{Vol.}\ \%$$

$$1.5 \leqq a/b \leqq 7.0$$

$$0.0 \leqq c/b \leqq 1.1, \text{ and}$$

$$d1 < d3 < d2$$

where, "a" denotes a volume fraction of the resin particle having the particle diameter d1 in the volume particle size distribution, and "b" and "c" denote volume fractions at particle diameters d2 and d3 respectively in the volume particle size distribution, wherein, "A", "t" and "B" satisfy the following formulas:

$$15 \leqq A \leqq 40$$

$$8.0 \leqq t \leqq 15.0$$

$$3.0 \leqq A \times B/100 \leqq 9.0,$$

where, "A" denotes a blending quantity of the resin particle relative to the resin 100 parts by mass, "t" denotes the thickness of the surface layer in microns, and "B" denotes the volume fraction of the resin particle having a particle diameter not less than 1.2 times the thickness of the surface layer in the volume particle size distribution.

2. The developing roller according to claim 1, wherein the resin particles have a peak P2 at the particle diameter d2, and the particle diameter d2 is the greatest representative particle diameter among representative particle diameters showing the maximum value in the volume particle size distribution.

3. The developing roller according to claim 2, wherein the resin particles have only two peaks of the peak P1 and the peak P2 in the volume particle size distribution.

4. The developing roller according to claim 1, wherein d1 is 7 μm or more and not more than 10 μm, and d2 is not less than 12 μm and not more than 20 μm.

5. The developing roller according to claim 1, wherein the distortion degree Rsk of the roughness curve is 0.3 or more and 0.6 or less.

6. The developing roller according to claim 1, wherein "t", "A", and "B" satisfy the following relational formulas:

$$9.0 \leqq t \leqq 12.0, \text{ and}$$

$$3.5 \leqq A \times B/100 \leqq 6.0.$$

7. The developing roller according to claim 1, wherein the surface hardness of the developing roller is 30 degrees or more and 38 degrees or less.

8. A developing apparatus, comprising at least monocomponent dry developer, a developing roller according to claim 1, and a developing blade for controlling the amount of the developer on the developing roller, wherein when the volume average particle diameter of the developer is taken as dt, the following relational formula is satisfied:

$$1.0 \leqq (d2 - d1)/dt \leqq 2.0.$$

9. The developing apparatus according to claim 8, wherein the volume average particle diameter of the developer is 5.0 μm or more and 6.5 μm or less.

10. The developing apparatus according to claim 8, further comprising a mechanism for applying a bias to the developing blade.

11. An image forming apparatus, comprising at least a developing roller according to claim 1 carrying a developer on the surface thereof, and a developing blade for controlling the amount of the developer on the developing roller.

* * * * *